US006786830B2

(12) United States Patent
Briggs et al.

(10) Patent No.: US 6,786,830 B2
(45) Date of Patent: Sep. 7, 2004

(54) MODULAR WATER PLAY STRUCTURE

(75) Inventors: Rick A. Briggs, Springfield, IL (US); Carin R. Brown, Aurora, CO (US); Richard T. Moran, Centennial, CO (US)

(73) Assignee: Koala Corporation, Englewood, CO (US)

( * ) Notice: Subject to any disclaimer, the term of this patent is extended or adjusted under 35 U.S.C. 154(b) by 0 days.

(21) Appl. No.: 10/199,396

(22) Filed: Jul. 18, 2002

(65) Prior Publication Data

US 2004/0014529 A1 Jan. 22, 2004

Related U.S. Application Data

(60) Provisional application No. 60/392,949, filed on Jun. 28, 2002.

(51) Int. Cl.[7] ..... A63H 23/16
(52) U.S. Cl. ..... 472/128; 472/117
(58) Field of Search ..... 472/116, 117, 472/128, 129; 104/53, 69, 70

(56) References Cited

U.S. PATENT DOCUMENTS

| | | | |
|---|---|---|---|
| 1,529,467 | A | 3/1925 | Davis et al. |
| 1,648,196 | A | 11/1927 | Rohmer |
| 1,935,543 | A | 11/1933 | Coughlin |
| 2,977,118 | A | 3/1961 | Farkas |
| 3,120,955 | A | 2/1964 | Carlin |
| 3,141,670 | A | 7/1964 | Smyrni et al. |
| 3,170,171 | A | 2/1965 | Mayhew et al. |
| 3,231,269 | A | 1/1966 | Dalrymple, Jr. |
| 3,246,892 | A | 4/1966 | Grudoski |
| 3,355,580 | A | 11/1967 | Wachs |
| 3,400,703 | A | 9/1968 | Rhodes |
| 3,539,181 | A | 11/1970 | Larsen ..... 272/56.5 |

(List continued on next page.)

FOREIGN PATENT DOCUMENTS

| | | |
|---|---|---|
| DE | 1 031 693 | 3/1956 |
| DE | 32 42 358 A1 | 11/1982 |
| DE | 38 12 435 C1 | 4/1988 |
| DE | 39 10679 A1 | 4/1989 |
| FR | 2 031 920 | 2/1969 |
| JP | 891541 | 2/1994 |
| WO | WO 96/29120 | 9/1996 |
| WO | WO 97/06867 | 2/1997 |

OTHER PUBLICATIONS

Sandman Playground Equipment Advertisement, Containing a Photograph of the "The Christiana" Playhouse, Apr. 9, 1987.

Braunfelsblit Products Brochure, New Braunfels General Store International, New Braunsfel, Texas, Jan. 1994.

Gym–Dandy, The Trusted One, Return of the Jedi, Scout Walker, Command Tower, Swing Set with Speeder Bike Rider No. 59340.

(List continued on next page.)

*Primary Examiner*—Kien T. Nguyen
(74) *Attorney, Agent, or Firm*—Sheridan Ross P.C.

(57) ABSTRACT

An improved water play structure, which integrates a single water supply network of conduit with a central support infrastructure, is provided. In one embodiment, a plurality of central pedestals are interconnected to water supply legs in a staircase manner in order to deliver a single water supply to a plurality of interactive water play elements. The size of the water play structure can be increased to accommodate additional play participants by adding decks to the structure. Interactive play modules consisting of water play elements and interactive play apparatuses can be easily interchanged, which facilitates servicing, simplifies design and manufacturing, and adds variety to a play participant's recreational experience. In addition, multiple water play structures can be interconnected to each other without the need for establishing separate water supply line connections.

67 Claims, 24 Drawing Sheets

U.S. PATENT DOCUMENTS

| | | | | |
|---|---|---|---|---|
| 3,570,848 | A | 3/1971 | Bowen | 272/60 |
| 3,601,397 | A | 8/1971 | Carlin et al. | 272/56.5 |
| D222,487 | S | 10/1971 | Korte | D34/5 |
| 3,633,560 | A | 1/1972 | DeFreitas | 124/11 |
| 3,662,729 | A | 5/1972 | Henderson | 124/11 |
| 3,668,715 | A | 6/1972 | Chase | 4/172 |
| D225,344 | S | 12/1972 | Henning et al. | D34/5 |
| 3,743,281 | A | 7/1973 | Gimbel | 272/56.5 |
| 3,752,472 | A | 8/1973 | Snead | 272/60 |
| 3,802,705 | A | 4/1974 | Burns et al. | 273/101 |
| 3,843,127 | A | 10/1974 | Lack | 273/101 |
| 3,851,880 | A | 12/1974 | Ritch | 273/128 R |
| 3,866,916 | A | 2/1975 | Clarke | 273/105.2 |
| 3,905,349 | A | 9/1975 | Nielsen et al. | 124/11 R |
| 3,938,272 | A | 2/1976 | Ditto et al. | 42/55 |
| D241,664 | S | 9/1976 | Ewers et al. | D34/5 H |
| 3,989,027 | A | 11/1976 | Kahelin | 124/58 |
| 4,014,540 | A | 3/1977 | Caulkins | 272/85 |
| 4,037,355 | A | 7/1977 | Street | 46/43 |
| D245,435 | S | 8/1977 | Gnehm | D34/5 H |
| 4,046,131 | A | 9/1977 | Clark et al. | 124/71 |
| D246,477 | S | 11/1977 | Callecod | D34/5 L |
| 4,057,244 | A | 11/1977 | Gaspar | 272/1 A |
| D250,782 | S | 1/1979 | Gibson | D34/5 K |
| D250,783 | S | 1/1979 | Dieter et al. | D34/5 L |
| D250,784 | S | 1/1979 | Dieter et al. | D34/5 E |
| D251,262 | S | 3/1979 | Barrett et al. | D21/244 |
| 4,145,042 | A | 3/1979 | Becker et al. | 272/56.5 R |
| 4,149,710 | A | 4/1979 | Rouchard | 272/56.5 R |
| 4,159,113 | A | 6/1979 | Callecod | 272/113 |
| 4,165,073 | A | 8/1979 | Kellerstrass | 273/101 |
| 4,165,729 | A | 8/1979 | Niemirow | 124/17 |
| D253,363 | S | 11/1979 | Dieter et al. | D21/244 |
| 4,186,927 | A | 2/1980 | Breslow et al. | 273/357 |
| 4,194,733 | A | 3/1980 | Whitehouse, Jr. | 272/56.5 R |
| 4,196,900 | A | 4/1980 | Becker et al. | 272/56.5 R |
| 4,198,043 | A | 4/1980 | Timbes et al. | 272/56.5 R |
| 4,219,198 | A | 8/1980 | Meyer et al. | 273/399 |
| 4,243,220 | A | 1/1981 | Shelley | 273/1 R |
| 4,251,069 | A | 2/1981 | Beller | 272/113 |
| 4,261,319 | A | 4/1981 | Dixon | 124/21 |
| 4,262,900 | A | 4/1981 | Vinson | 272/113 |
| 4,303,247 | A | 12/1981 | Fain | 273/324 |
| 4,343,464 | A | 8/1982 | Dose | 272/56.5 R |
| 4,418,792 | A | 12/1983 | Cerone | 182/93 |
| 4,487,411 | A | 12/1984 | Ahrens | 272/56.5 R |
| D277,610 | S | 2/1985 | Arginsky | D23/6 |
| D277,640 | S | 2/1985 | Drexler | D8/88 |
| 4,505,897 | A | 3/1985 | Coy et al. | 514/11 |
| 4,548,357 | A | 10/1985 | Schmidt | 239/289 |
| 4,573,679 | A | 3/1986 | Janszen | 273/26 E |
| 4,630,709 | A | 12/1986 | Taylor | 182/48 |
| 4,778,430 | A | 10/1988 | Goldfarb et al. | 446/167 |
| 4,786,088 | A | 11/1988 | Ziu | 285/138 |
| 4,799,665 | A | 1/1989 | Bracy | 272/1 R |
| 4,805,896 | A | 2/1989 | Moody | 272/56.5 R |
| 4,805,897 | A | 2/1989 | Dubeta | 272/56.5 R |
| 4,805,898 | A | 2/1989 | Jacober et al. | 272/56.5 R |
| D302,198 | S | 7/1989 | Mercer | D21/245 |
| 4,865,312 | A | 9/1989 | Katz | 272/56.5 R |
| 4,898,198 | A | 2/1990 | Castlebury | 135/90 |
| 4,951,644 | A | 8/1990 | Bon | 124/75 |
| 4,961,535 | A | 10/1990 | Skibik | 239/289 |
| 4,973,042 | A | 11/1990 | Klopf et al. | 272/35 |
| 5,000,155 | A | 3/1991 | Gallagher | 124/71 |
| 5,011,134 | A | 4/1991 | Langford | 272/56.5 R |
| 5,011,161 | A | 4/1991 | Galphin | 273/349 |
| 5,113,842 | A | 5/1992 | Moormann | 124/65 |
| 5,115,794 | A | 5/1992 | Moormann | 124/65 |
| 5,127,657 | A | 7/1992 | Ikezawa et al. | 273/310 |
| 5,133,330 | A | 7/1992 | Sharp | 124/56 |
| 5,135,440 | A | 8/1992 | Smollar et al. | 472/128 |
| 5,151,069 | A | 9/1992 | Skalka | 482/35 |
| D330,579 | S | 10/1992 | Briggs | D21/243 |
| 5,156,339 | A | 10/1992 | Gibson et al. | 239/289 |
| 5,176,060 | A | 1/1993 | Thornton | 83/471.2 |
| 5,194,048 | A | 3/1993 | Briggs | 472/128 |
| 5,213,547 | A | 5/1993 | Lochtefeld | 472/117 |
| 5,224,701 | A | 7/1993 | Sciarrillo et al. | 273/55 R |
| 5,226,864 | A | 7/1993 | Showers | 482/35 |
| D340,273 | S | 10/1993 | Ezell | D21/244 |
| 5,251,906 | A | 10/1993 | Heller et al. | 273/397 |
| 5,256,120 | A | 10/1993 | Howell | 482/82 |
| 5,288,071 | A | 2/1994 | Solomon | 273/85 C |
| 5,330,400 | A | 7/1994 | Huberman | 482/35 |
| 5,343,849 | A | 9/1994 | Steer | 124/72 |
| D352,327 | S | 11/1994 | Delaney et al. | D21/249 |
| 5,378,197 | A | 1/1995 | Briggs | 472/128 |
| 5,382,026 | A | 1/1995 | Harvard et al. | 273/310 |
| 5,385,472 | A | 1/1995 | Mullin | 434/126 |
| 5,387,158 | A | 2/1995 | Bertrand | 472/117 |
| 5,387,159 | A | 2/1995 | Hilgert et al. | 472/128 |
| 5,401,214 | A | 3/1995 | Smollar et al. | 472/117 |
| D357,299 | S | 4/1995 | Laing et al. | D21/242 |
| 5,405,294 | A | 4/1995 | Briggs | 472/128 |
| D358,190 | S | 5/1995 | Strawcutter et al. | D21/242 |
| 5,417,435 | A | 5/1995 | Peretz | 273/355 |
| 5,431,410 | A | 7/1995 | Hampton | 273/355 |
| 5,435,570 | A | 7/1995 | Labrasseur | 273/355 |
| D361,116 | S | 8/1995 | Shaneour | D21/244 |
| 5,437,573 | A | 8/1995 | Rodriguezferre | 472/116 |
| 5,447,144 | A | 9/1995 | Ivy | 124/26 |
| 5,450,838 | A | 9/1995 | Nakahigashi et al. | 124/56 |
| D366,086 | S | 1/1996 | Ziegler, Jr. et al. | D21/245 |
| 5,480,336 | A | 1/1996 | Blanchard | 446/89 |
| 5,505,663 | A | 4/1996 | Goulart et al. | 472/116 |
| 5,507,271 | A | 4/1996 | Actor | 124/56 |
| 5,507,696 | A | 4/1996 | Smollar et al. | 472/117 |
| 5,515,837 | A | 5/1996 | Nin et al. | 124/59 |
| D371,414 | S | 7/1996 | King | D21/242 |
| 5,536,210 | A | 7/1996 | Barber | 472/128 |
| 5,554,074 | A | 9/1996 | Von Parrish | 472/116 |
| D374,901 | S | 10/1996 | Cacciola et al. | D21/240 |
| 5,577,945 | A | 11/1996 | LaBelle | 446/75 |
| 5,580,316 | A | 12/1996 | Hill et al. | 472/116 |
| 5,649,867 | A | 7/1997 | Briggs | 472/128 |
| D382,618 | S | 8/1997 | Gift | D21/240 |
| 5,662,525 | A | 9/1997 | Briggs | 472/128 |
| 5,669,822 | A | 9/1997 | Smollar et al. | 472/117 |
| 5,673,918 | A | 10/1997 | Bigari | 273/395 |
| 5,676,602 | A | 10/1997 | Katz et al. | 472/117 |
| D385,941 | S | 11/1997 | Carpenter | D21/240 |
| 5,683,314 | A | 11/1997 | Musso | 473/414 |
| 5,685,778 | A | 11/1997 | Sheldon et al. | 472/43 |
| D389,892 | S | 1/1998 | Van Wagenen | D21/245 |
| 5,709,581 | A | 1/1998 | Rothbarth et al. | 446/171 |
| D393,687 | S | 4/1998 | Griger et al. | D21/242 |
| 5,735,748 | A | 4/1998 | Meyers et al. | 472/117 |
| 5,741,189 | A | 4/1998 | Briggs | 472/128 |
| 5,785,592 | A | 7/1998 | Jacobsen | 463/7 |
| D397,188 | S | 8/1998 | Bro et al. | D21/243 |
| 5,816,980 | A | 10/1998 | Myszka et al. | 482/35 |
| 5,820,471 | A | 10/1998 | Briggs | 472/128 |
| 5,820,472 | A | 10/1998 | Briggs | 472/128 |
| 5,839,964 | A | 11/1998 | Rudell et al. | 472/117 |
| D403,392 | S | 12/1998 | Briggs et al. | D21/814 |
| 5,853,332 | A | 12/1998 | Briggs | 472/128 |
| 5,865,679 | A | 2/1999 | Seabolt et al. | 472/117 |
| 5,865,680 | A | 2/1999 | Briggs | 472/128 |
| D406,871 | S | 3/1999 | Briggs | D21/811 |
| D407,133 | S | 3/1999 | Briggs | D21/826 |

| | | | | | |
|---|---|---|---|---|---|
| 5,884,563 | A | | 3/1999 | Sheldon et al. | 104/53 |
| D413,957 | S | | 9/1999 | Briggs | D21/826 |
| 5,967,901 | A | | 10/1999 | Briggs | 472/128 |
| 5,967,916 | A | | 10/1999 | Robeson | 473/600 |
| D416,066 | S | | 11/1999 | Briggs | D21/814 |
| D421,283 | S | | 2/2000 | Briggs et al. | D21/811 |
| 6,089,987 | A | * | 7/2000 | Briggs | 472/128 |
| 6,132,318 | A | * | 10/2000 | Briggs | 472/128 |

OTHER PUBLICATIONS

Innovative Foam Technology Inc. Product Brochure, Wimberly, Texas.

Innovative Foam Technology Inc. Product Brochure, San Antonio, Texas.

Innovative Foam Technology Inc.—Introduction Sheet to Soft, Lightweight Participatory Play Equipment, 1991.

Interactive WaterPlay Systems Brochure, SCS Company, 1995.

Mexico Forge Brochure, 3800 Series, Model 3813–311.

The Foam Factory Pamphlet, SCS Interative Inc.

The Pentes Playbill Newspaper, Pentes Play Inc., Showtime 1995.

Sampler Catalog, Pentes Play Inc., 1995.

The Pentes Playbill Newspaper, Pentes Play Inc., Autumn 1995.

The Pentes Playbill Newspaper, Pentes Play Inc., Show Edition 1996.

The Pentes Playbill Newspaper, Pentes Play Inc., Spring 1997.

The Pentes Playbill Newspaper, Pentes Play Inc., Show Edition 1998.

SCS Interative Family Adventures Discovery Treehouse Brochure, SCS Company, Tillamook, Oregon.

SCS Interactive Family Adventures Creative Waterplay Components Brochure, SCS Company.

SCS Interactive Family Adventures Pirate Fortress Brochure, SCS Company.

SCS Interactive Family Adventures Family Caribbean Adventure, SCS Company.

The Interactive Water Funh$_2$ouse Brochure, SCS Interactive Inc., Tillamook, Oregon, 1997.

The Interactive Waterplay Arena, SCS Interactive Inc., Tillamook, Oregon, 1997.

SCS Interactive Something Big Is Coming Brochure, SCS Company, Tillamook, Oregon, May 2000.

SCS Company Products Brochures, Models 107–400.

Soft Play Inc. Brochure, 1994.

Specialty Products and Replacement Parts Catalog, Specialty Products Inc., Nov. 1994.

World Waterpark Association, Splash, SCS Participatory Play Systems, Sep. 1989.

Playthings, Yards of Fun Inc., Sep. 1987, p. 61.

Parks & Recreation Magazine; Mar. 1999; pp. 1–188 and covers.

Six Color Photographs of Whitewater West Industries' waterplay system in Collinsville, IL, circa late Aug.–early Sep. 2002.

* cited by examiner

MODULAR WATER PLAY STRUCTURE

Priority is claimed from U.S. Provisional Application, Serial No. 60/392,949, entitled "MODULAR WATER PLAY STRUCTURE", filed Jun. 28, 2002, which is incorporated herein in its entirety. Cross-reference is also made to U.S. Pat. No. 5,194,048, entitled "PARTICIPATORY WATER PLAY APPARATUS", issued Mar. 16, 1993; U.S. Pat. No. 5,405,294, entitled "PARTICIPATORY WATER PLAY APPARATUS", issued Apr. 11, 1995; U.S. Pat. No. 5,662,525, entitled "PARTICIPATORY WATER PLAY APPARATUS", issued Sep. 2, 1997; and U.S. Pat. No. 5,820,471, entitled "PARTICIPATORY WATER PLAY SYSTEM", issued Oct. 13, 1998, all of which are incorporated herein in their entireties.

FIELD OF THE INVENTION

The present invention relates to the field of water play structures, and more particularly to a play system structure with a central pedestal that is pressurized by water.

BACKGROUND OF THE INVENTION

Water theme parks and recreational water facilities have become quite popular in the last decade. Water parks have proliferated as adults and children, alike, seek the thrill and entertainment of water parks as a healthy and enjoyable way to cool off in the hot summer months. Water play structures have been developed to allow for interactive use by play participants. These play structures often, but not always, resemble multi-level play structures that one might see in parks, etc., and are generally supported by many metal columns.

Typically, such water play structures are constructed in conjunction with and sit inside a water collection pool or basin. These pools are often pre-existing, but sometimes are purpose-built, and often have unique, or at least non-standard, characteristics. Such characteristics could include pool shape and environmental anomalies.

There is generally also a pump associated with a water play structure system. The pump is usually designed to force water to, through, and out of various water forming or other devices found on typical water play structures. As the water exits the water forming or other device, it generally cascades downward or outward from the device. That water is typically collected in the pool or water collection basin so that the collected water may be fed back to the pump and re-circulated for essentially continuous use.

Filtration and treatment of the re-circulating water also generally occurs on a systematic and periodic basis. On occasion, additional water must also be added to the system to account for fluid loss due to any number of environmental and other factors.

Though many improvements have been made to water play structures over the years, there are still a number of problems which need to be addressed in such systems. One such problem relates to quickly, efficiently, and uniformly installing the water play structures into collection basins of virtually any shape, size or configuration. As stated earlier, there are generally multiple vertical support columns on each water play structure of prior designs, each column needing to be fitted and formed to the particular grade of the collection basin in which the system is to be installed. Tailoring each water play structure vertical support column to accommodate the slope of a particular grade is costly and inhibits mass production and uniform installation procedures. Accordingly, a water play structure is needed that can be adapted to varying collection basins without having to adjust the height of several, independent, vertical support columns.

One way to address the above-stated installation and fabrication problem is to create a water play structure utilizing a central support pedestal. Such a pedestal can be installed in one location and levels of the play structure can be built therefrom. While central pedestal structures have been used in dry play and other environments, there has never been, to Applicants' knowledge, a central support pedestal structure utilized with regard to water play structures. Moreover, an additional benefit to using a central support pedestal is that the central pedestal can be utilized and adapted to transmit pressurized water from the pump to all of the water forming or other devices which may be installed upon the water play structure. In such a configuration, the central support structure pedestal serves not only a support function, but also a water movement function.

Another problem with water play structures currently known in the art is that they utilize an independent conduit structure for transmitting pressurized water to the various water play elements disposed throughout the play structure. As a result, as additional play levels, which include additional water play elements, are added to a particular play structure, additional conduit is needed to transmit the water supply to the added level, which can be costly. Thus, there is a need for a play structure that uses a single integrated structure to not only support play participants, but to transmit pressurized water to various interactive water play elements disposed throughout the structure.

Another problem with water play structures currently known in the art is that if a developer wants to link several water play structures together in a particular site, he or she must use multiple connections to a single water supply or use multiple water supplies. Each additional structure thus requires new connection of feed pipe and the like. Thus, there is a need for a water play structure that can be adapted to accommodate additional play structures without the need for separate connections to a single water supply or to multiple water supplies.

Finally, water play structures are known that use both interactive water and non-water play elements. However, these play elements, once installed, are not typically interchangeable or easily movable from one site on a play structure to another. This limitation makes servicing the play elements difficult and restricts an operator's ability to manipulate or add new play elements to vary the play participants' recreational experience. Thus, there is a need for a water play structure which can be easily adapted to accommodate various, interactive water and non-water play elements.

SUMMARY OF THE INVENTION

The present invention is designed to overcome the aforementioned problems and meet the aforementioned, and other, needs. It is one aspect of the present invention to provide a multi-level, water play structure that eliminates the need for various vertical support columns, which must be individually tailored to accommodate various collection basin environmental constraints. It is another aspect of the present invention to provide a water play structure that integrates a water supply network of conduit with a central support infrastructure. It is a further aspect of the present invention to provide a water play structure that uses a single water supply line connection to transmit water to adjacently situated water play structures. It is yet a further aspect of the present invention to provide a water play structure having modular, interactive water and non-water play elements that can be easily interchanged and moved, depending on operator needs.

In one embodiment of the current invention, a water play structure is generally comprised of a hollow, central pedestal interconnected to at least one water supply leg. The central pedestal is further comprised of a water supply line connection, which is used to transmit pressurized water to the water supply leg.

The water supply leg is made of conduit and is used to transfer pressurized water from the central pedestal to water play elements. The water supply leg may also partially or wholly support a polygonal deck to be used by play participants.

In one embodiment, the deck (i.e., platform) may be interconnected to the central pedestal for additional stability or to other structures developed for such purposes. Telescoping support columns may also be used to further support the polygonal deck (i.e., platform) and/or water supply leg.

In one embodiment, a water play structure can be linked to a second water play structure without the need for a separate water supply line. Instead, water may be delivered from the central pedestal of the first water play structure to the second water play structure.

In one embodiment, a water play structure adapted for use in a playground or park is provided, comprising:

(a) a hollow central pedestal having at least one supply line for receiving fluid;

(b) a first water supply leg, which is in fluid connection with the central pedestal and may be adapted to, at least partially, support play participants and transport fluid from the hollow central pedestal;

(c) a deck, at least partially supported by the first water supply leg; and (d) at least one water play element capable of dispensing fluid received from the first water supply leg.

Other objects, features, embodiments, and advantages of the invention will be apparent from the following specification taken in conjunction with the following drawings.

Figure 1A:
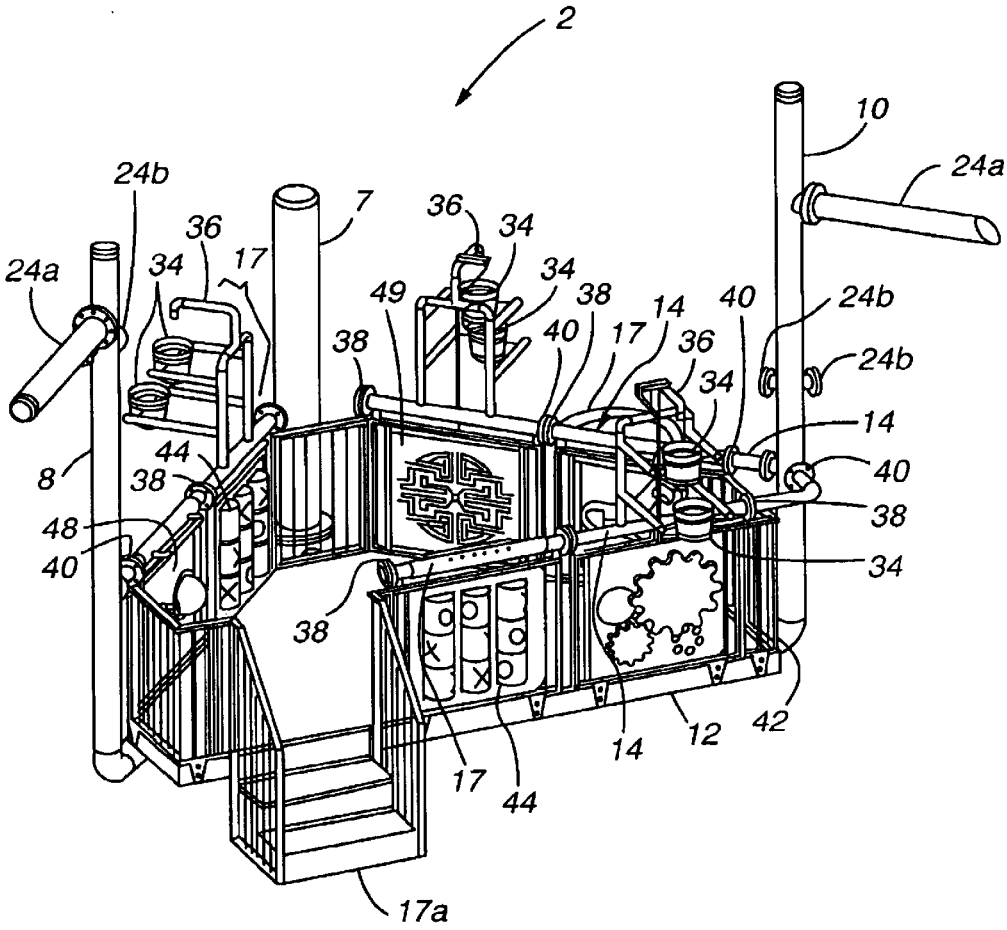
FIG. 1A is a front isometric perspective view of one embodiment of a single level modular water play structure.

The following components and numbers associated thereto are shown in the drawings and provided here for ease of reference:

| No. | Component |
|---|---|
| 2 | Modular Water Play Structure |
| 3 | Pool |
| 4 | First Central Pedestal |
| 6 | Water Supply Line Connector |
| 7 | Cap |
| 8 | First Water Supply Leg |
| 10 | Second Water Supply Leg |
| 12 | First Polygonal Deck |
| 14 | Railing |
| 16 | Interactive Play Apparatus |
| 17 | Water Play Element |
| 17a | Stairs |
| 18 | Pool Floor |
| 19 | Conduit |
| 20 | First End of First Central Pedestal |
| 21 | Second End of First Central Pedestal |
| 22 | Deck Connection Means |
| 23 | Water Supply Leg Connection Means |
| 24 | Concrete Footing |
| 24a | Spout/Conduit |
| 24b | Blind Flange |
| 25 | Drain |
| 26 | Pump |
| 27 | Interactive Play Module |
| 28 | Frame |

-continued

| No. | Component |
|---|---|
| 30 | Attachment Means |
| 32 | Sprinkler |
| 34 | Bucket |
| 36 | Faucet |
| 38 | First End of Railing |
| 40 | Second End of Railing |
| 42 | Spindle |
| 44 | Tic-Tac-Toe Module |
| 46 | Gear-Oriented Module |
| 47 | Propeller-Mounted Module |
| 48 | Spinning Ball Module |
| 49 | Maze-Oriented Module |
| 50 | Slide Module |
| 51 | Second Level |
| 52 | Second Central Pedestal |
| 54 | Third Water Supply Leg |
| 58 | Second Polygonal Deck |
| 60 | First Support Member |
| 62 | Third Level |
| 64 | Third Central Pedestal |
| 66 | Fourth Water Supply Leg |
| 68 | Third Polygonal Deck |
| 70 | Second Support Member |
| 72 | Fourth Level |
| 74 | Fourth Central Pedestal |
| 76 | Fourth Polygonal Deck |
| 78 | Third Support Member |
| 80 | Fourth Support Member |
| 82 | Adjustable Support Column |
| 84 | Stationary Post |
| 86 | Telescoping Sleeve |
| 88 | Aperture |
| 90 | Bolt |
| 92 | Second Supply Line Connection |
| 94 | Gasket |
| 96 | Valve |

DETAILED DESCRIPTION OF THE PREFERRED EMBODIMENT

While this invention is susceptible of embodiments in many different forms, there are shown in the drawings and will herein be described in detail, preferred embodiments of the invention. The reader is to understand that the present disclosure is to be considered as an exemplification of the principles of the invention and is not intended to limit the broad aspects of the invention to the embodiments illustrated.

Figure 1B:
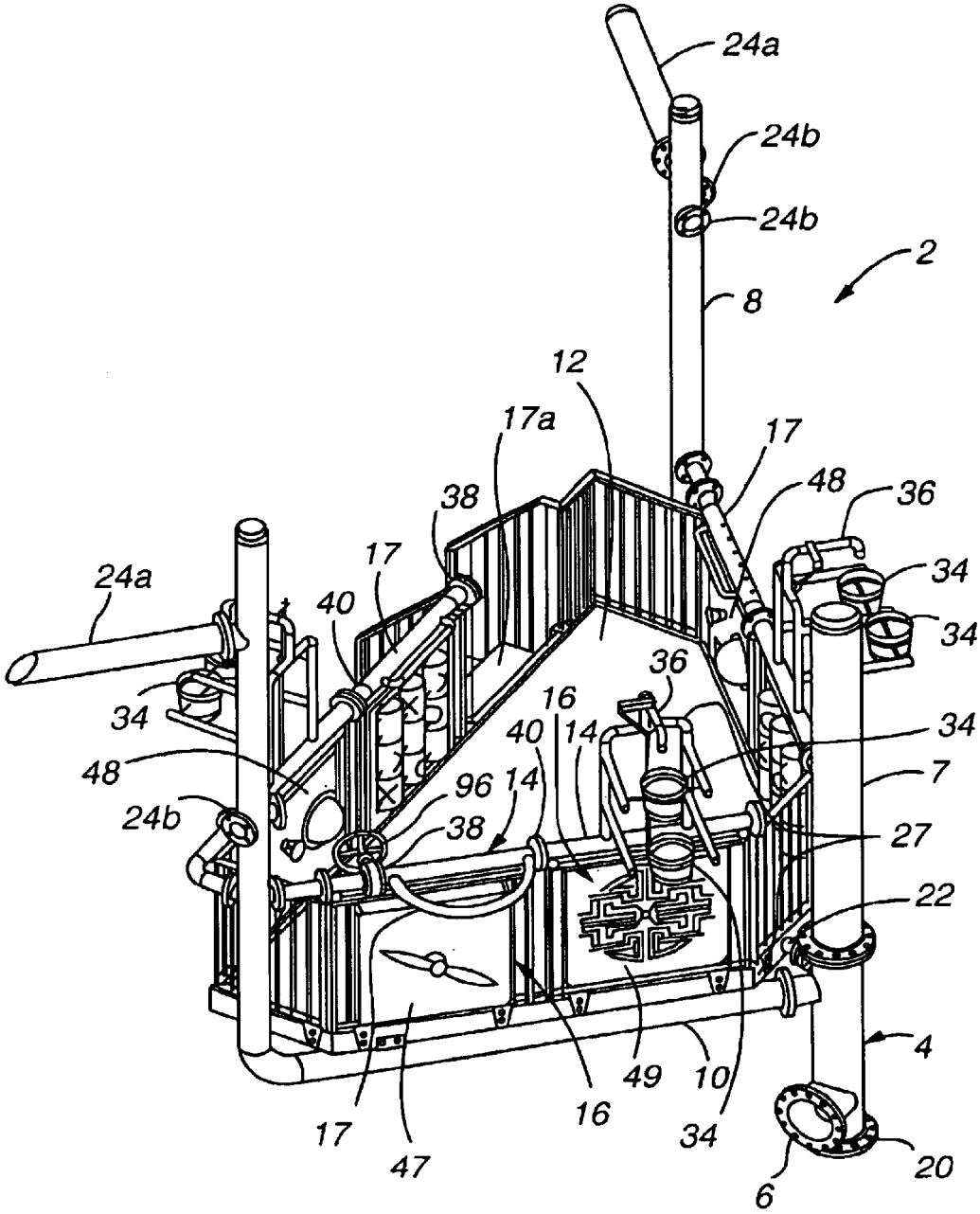
FIG. 1B is a right isometric perspective view of the modular play structure showing FIG. 1A.
Figure 1C:
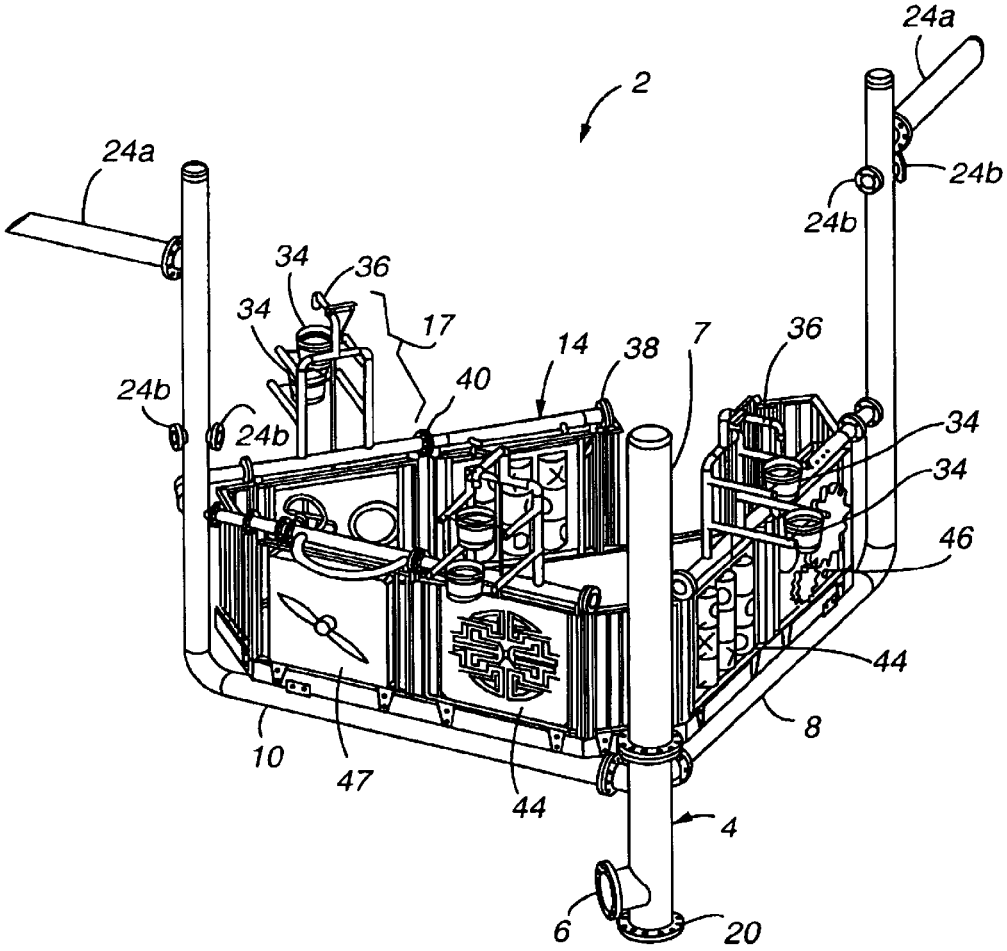
FIG. 1C is a rear perspective view of the modular play structure shown in FIG. 1A.
Figure 2:
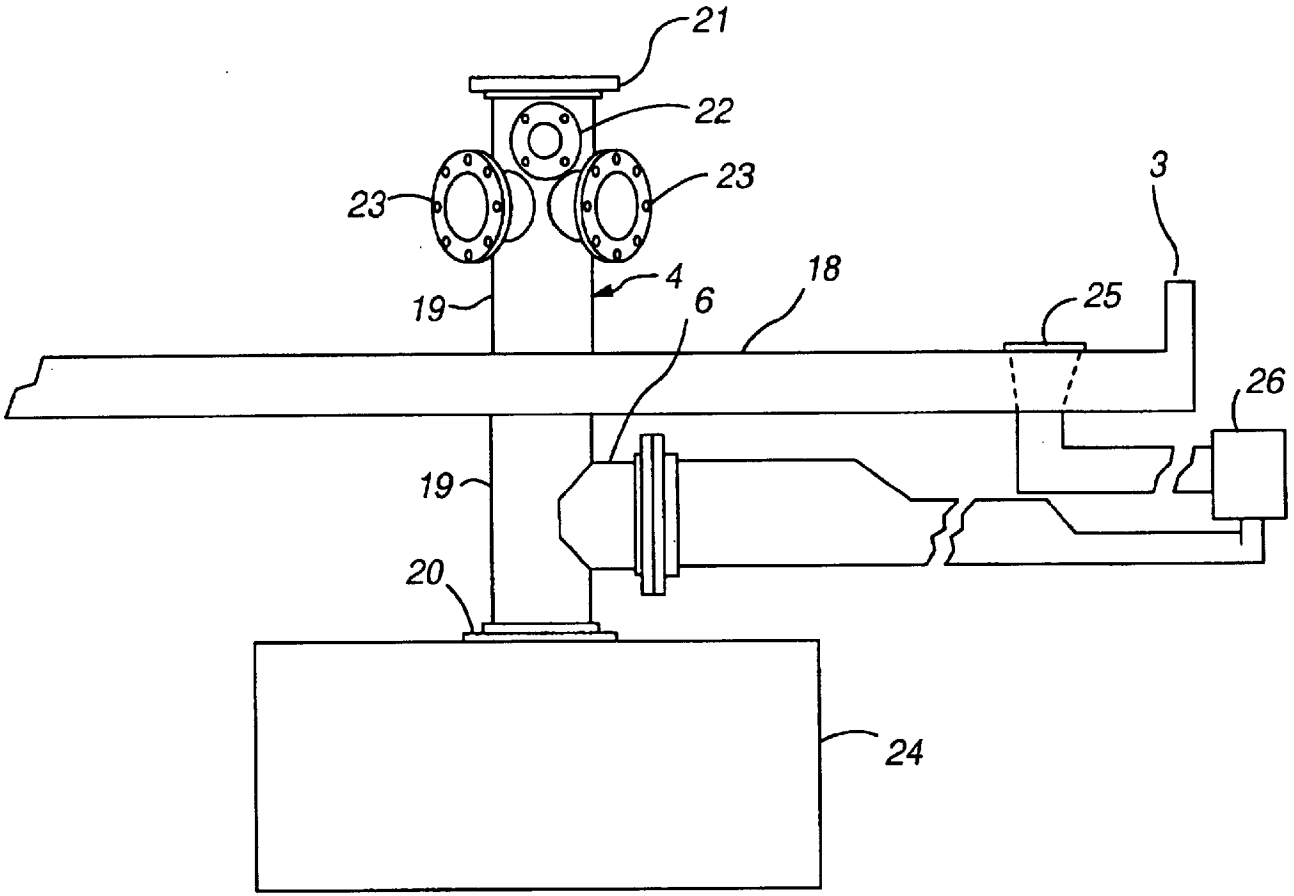
FIG. 2 is a front perspective view of one embodiment of a first central pedestal.

Referring now to the drawings, FIGS. 1A, 1B, and 1C illustrate front, side, and rear isometric views of one embodiment of the inventive modular water play structure 2, which can be easily adapted to a variety of sloped basins or pools 3 (shown in FIG. 2). In general, the modular water play structure 2 is comprised of a first central pedestal 4, which has a water supply line connection 6 for transmitting water from a water supply. The first central pedestal, in addition, has multiple other ports 23 that can be used to supply water to other areas of the water play structure. The first central pedestal also has two ends. One of the ends 20 is designed to be fastened to a cement footing or other appropriate structure device installed below, at, or near a pool bottom or other appropriate area within a collection basin. A cap 7 may be removably interconnected to the other end of the first central pedestal 4 in order to contain water flow from the central pedestal 4. Obviously, in lieu of a cap 7, a separate water play element 17 can be added to communicate with a top of the first central pedestal 4. See, e.g., FIG. 8A.

The first central pedestal 4 may be connected, in known fashion, to a first water supply leg 8 and a second water supply leg 10, etc. A first polygonal deck 12 may be partially supported by the first water supply leg 8 and second water supply leg 10, etc. A plurality of interchangeable railings 14, which also may transfer pressurized water, communicate with the first water supply leg 8 and second water supply leg 10, etc. Further, a plurality of interchangeable, interactive play apparatuses 16 may be interposed between the polygonal deck 12 and the plurality of railings 14. As further described below, various interchangeable water play elements 17 may be interconnected to the first water supply leg 8, second water supply leg 10, and plurality of railings 14. Play participants may access the polygonal deck 12 via stairs 17*a*, a ramp, or similar structure.

As shown in FIG. 2, the first central pedestal 4 acts as a main conduit for supplying water to the modular water play structure 2. In addition, the first central pedestal 4 serves as the central support structure for the modular water play structure 2. Use of such a structure eliminates the need for multiple, individual vertical support columns which often must be individually tailored to the particular configuration of a pool 3, such as the slope of the pool floor 18.

In one preferred embodiment, the first central pedestal 4 is comprised of a substantially cylindrical conduit 19 with a first end 20 and a second end 21. The pedestal also has a means 22 (e.g., a flange) for connecting a first polygonal deck 12 to the conduit 19, a means 23 (e.g., flange) for connecting the first and second water supply legs 8, 10 to the conduit 19, and the water supply line connection 6. The first end 20 of the first central pedestal 4 may be anchored beneath the pool floor 18 via a concrete footing 24, which varies in shape and size according to the number of polygonal decks supported thereby and other environmental factors. In one embodiment, the concrete footing 24 is six to eight foot square and two to three foot thick, with rebar reinforcements. J-bolts are optionally used to secure the first end 20 of the conduit 19 to the concrete footing 24. It will be understood by those skilled in this art that other appropriate devices and/or members can be used to secure the first central pedestal 4 to a collection basin surface.

If no additional polygonal decks are desired, the second end 20 of the first central pedestal 4 may be connected in any suitable manner to a cap 7, which is designed to prevent water from flowing out of the second end 21 of the first central pedestal 4. Alternatively, the first central pedestal 4 can be manufactured with a closed second end 21.

As shown in FIGS. 1A–1C, the first water supply leg 8 and second water supply leg 10 may partially support the first polygonal deck 12 and may transmit pressurized water to water play elements 17 generally disposed upon railings 14 or on the first and second water supply legs 8, 10, or both. In one embodiment, the first and second water supply legs 8, 10 are pipe-like and L-shaped.

As one ordinarily skilled in the art can appreciate, other manners or shapes of pipe, tubing, or other functionally shaped water-carrying conduit of sufficient strength and size to transmit pressurized fluid are within the spirit and scope of the present invention. Moreover, the present invention is not limited to a particular type of water play element 17. For example, a faucet 36 and tipping buckets 34 are shown in FIG. 1A, but other water play elements 17 may be substituted for these elements or these elements may be moved to different positions on the structure.

Blind flanges 24*b* may be used to cap the first water supply leg 8 and second water supply leg 10 when those water transfer positions are not in use. Additional conduit 24*a* may be attached to flanges formed in first water supply leg 8 and second water supply leg 10 as may be necessary. Such conduit 24*a* can be used to supply pressurized water to additional water play structures or to other types of water play elements, play pods, etc. Alternatively, the conduit 24*a* could be simply used as a water spout.

As previously noted, water may be emitted from various water play elements 17 positioned about the water play structure 2. The emitted water is collected in the pool 3. The pool 3 may vary from a substantially zero depth to a depth of several feet depending on the needs of the operator. As shown in FIG. 2, in one embodiment, the pool 3 is further comprised of a drain 25, which allows the water to circulate back to the water supply. The drain 25 may communicate with a central water supply or the fluid exiting the drain may be held in a storage facility. In either case, a pump 26, which can be positioned on the pool floor 18, or on a skid which is anchored to the water play structure 2, or remote thereto, may be used to move fresh and/or re-circulated water to the water play structure 2. As one skilled in the art can appreciate, the size and power of the pump 26 will be dictated by the volume of water to be moved, the distance that the water must travel, the pressure required to operate the water play elements 17 on various levels of the modular water play structure 2, etc.

An additional aspect of the present invention is to provide the ability to quickly and easily modify and interchange, if necessary, interactive play modules 27 (see, e.g., FIG. 3A) to accommodate operator needs. In one embodiment, the interactive play module 27 is comprised of at least one railing 14 (see FIG. 3B) interconnected to a frame 28, which houses an interactive play apparatus 16 and which may be secured to the first polygonal deck 12 via an appropriate attachment means 30. Such an attachment means 30 may be a flange, bracket, bolts, weld, epoxy glue, rivets, or other similar device. This modular configuration provides a myriad of combinations for the operator and facilitates quick replacement of the entire interactive play module 27, if desired. See FIGS. 3A and 3B. This ease of interchangeability also facilitates servicing of the play structure 2 and the play elements 17, and simplifies design and manufacture of both the interactive play modules 27 and overall play structure 2.

Figure 3A:
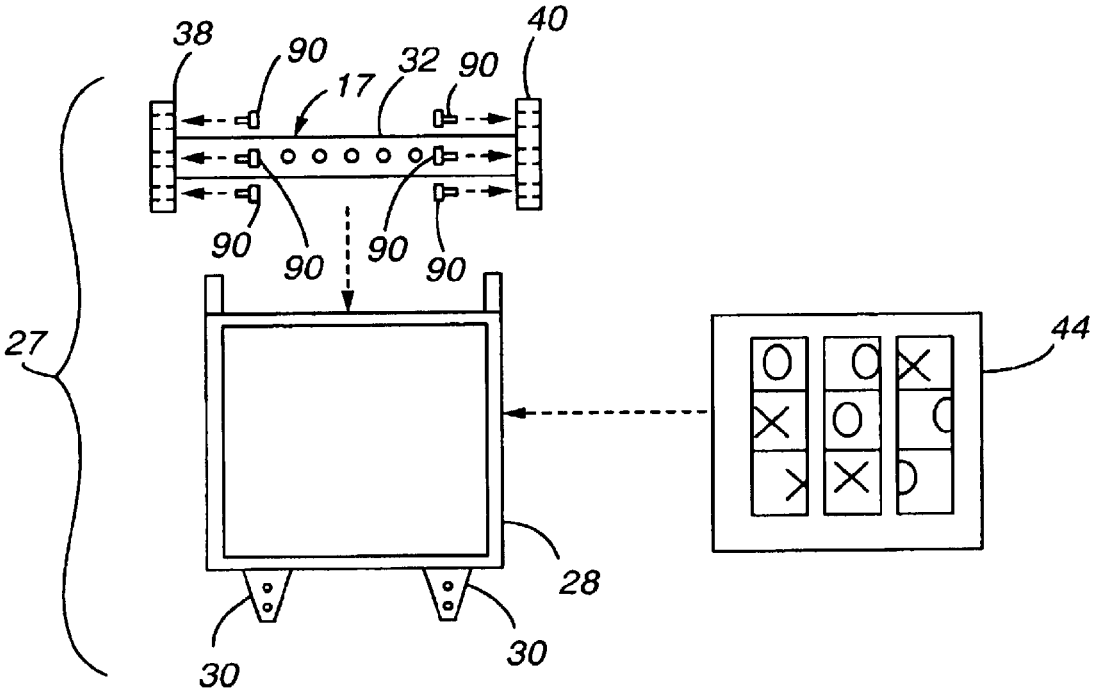
FIG. 3A is an exploded, front elevation view of one embodiment of an interactive play module for the modular play structure.
Figure 3B:
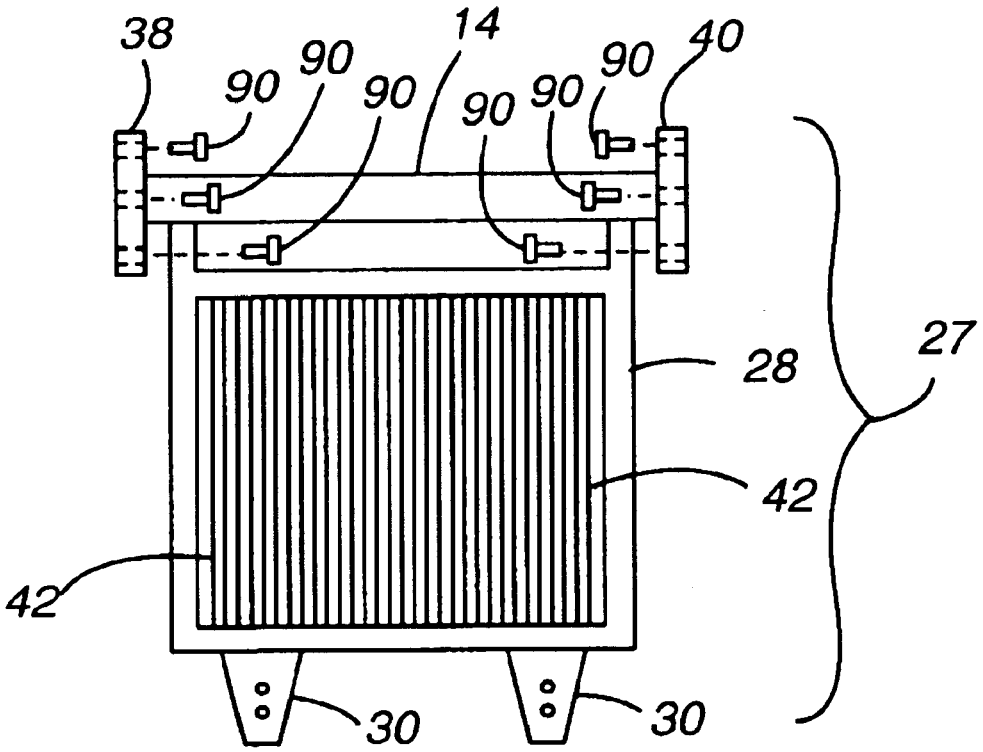
FIG. 3B is a front elevation view of one embodiment of an interactive play module for the modular play structure.

As shown in FIGS. 1A, 3A, and 3B, the railing 14 can be swapped with various water play elements 17 (e.g., sprinkler 32, series of swiveling buckets 34 coupled to a faucet 36, etc.). In one embodiment, the railing 14 has a first end 38 and a second end 40, each of which is preferably flanged so that the railing 14 can be easily removed for servicing or replacement. The railing 14 can be made out of metal, metal alloy, or other material having similar strength and durability characteristics, or a combination thereof.

The railing frame 28 can house spindles 42 (see FIG. 3B), the interactive play apparatus 16 (see FIG. 3A), or both. As shown in FIG. 1A, different interactive play apparatuses 16, such as a Tic-Tac-Toe module 44, a gear-oriented module 46, a propeller-mounted module 47, a spinning ball module 48, a maze-oriented module 49, or a slide module 50 (not shown), can be easily interchanged within an interactive play module 27, depending on the needs of the operator. If the operator so desires, the entire interactive play module 27 can also be removed and replaced by simply disconnecting the attachment means 30 and the first end 38 and, if necessary, the second end 40 of the railing 14, and replacing the interactive play module 27 with another pre-assembled interactive play module 27.

The aforementioned interactive play apparatuses 16 and water play elements 17 are intended to be for illustrative purposes only. As one ordinarily skilled in the art can appreciate, other interactive play apparatuses 16 and/or water play elements 17 may be used alone, or in combination, without departing from the spirit and scope of the present invention.

Another aspect of the present invention is to provide a modular water play structure 2 which can easily adapt to accommodate additional play participants. Depending on the projected number of play participants, additional polygonal decks can easily be added to the structure, building off of the first central pedestal 4. This is accomplished by adding additional decks and corresponding water supply legs to the central pedestal 4.

Figure 4A:
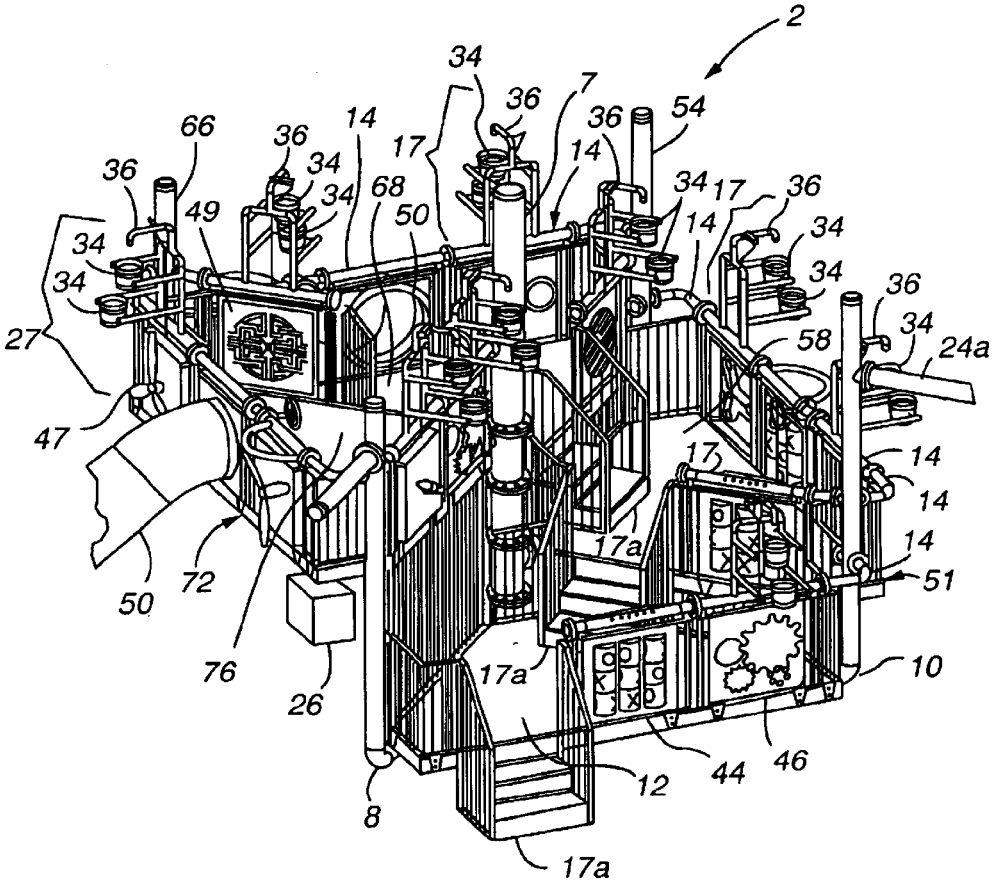
FIG. 4A is a front isometric perspective view of one embodiment of a four level modular water play structure.
Figure 4B:
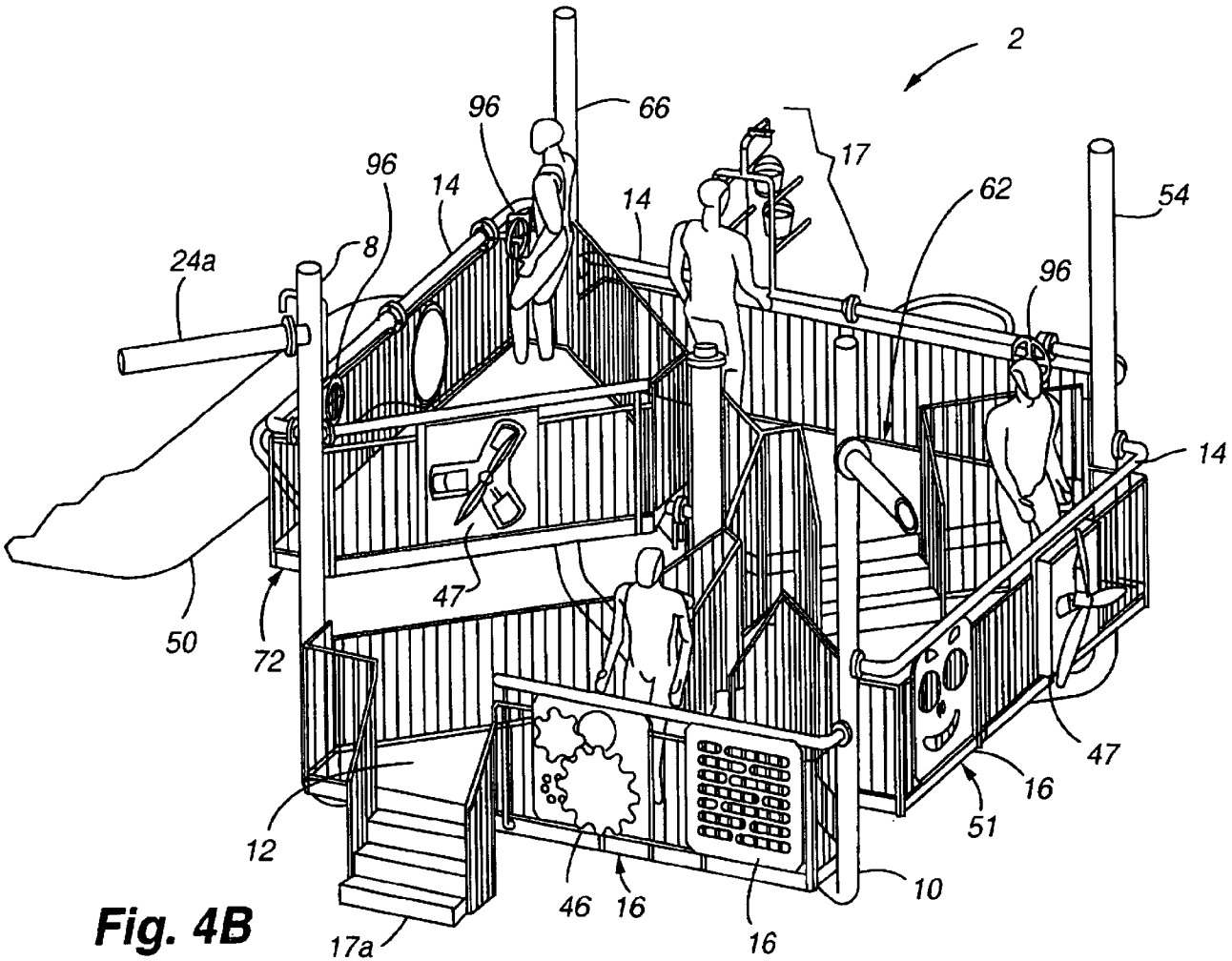
FIG. 4B is a front isometric perspective view of one embodiment of a four level modular water play structure with play participants.

As shown in FIGS. 4A and 4B, in one embodiment, up to a four level water play structure 2 can be achieved by tiering polygonal decks in a staircase manner. The decks may be located at different heights on the central pedestal by adding central pedestal sections. Each additional polygonal deck may be supported, in part, by the polygonal deck that precedes it.

For instance, in order to achieve a second level 51, a second central pedestal 52 is connected to the first central pedestal 4 that is anchored near, to, or beneath the pool floor 18. See FIGS. 5A–5C. A third water supply leg 54 may be connected to the second central pedestal 52 so that water can be carried to water play elements 17 positioned on railings 14 on the second level 51 of the water play structure 2. In addition, the third water supply leg 54 may partially support a second polygonal deck 58. The second polygonal deck 58 may also be partially supported by the second water supply leg 10 via a first support member 60. In one embodiment, additional stairs 17*a* are positioned from the first polygonal deck 12 to an edge of the second polygonal deck 58.

If a third level 62 to the play structure is desired, as shown in FIGS. 6A–6D, a third central pedestal 64 may be connected to the second central pedestal 52. Similarly, a fourth water supply leg 66 may be connected to the third central pedestal 64 in order to carry water to further water play elements 17 on the third level 62 and to partially support a third polygonal deck 68. The third polygonal deck 68 may be supported in a similar fashion, as described above, by a second support member 70 that spans between the second polygonal deck 58 and the third polygonal deck 68. Stairs 17*a* may also connect the second polygonal deck 58 and third polygonal deck 68 so that play participants can freely move between the second and third levels 51, 62.

Turning now to FIGS. 3 and 7A–7G, if the operator requires a fourth level 72, a fourth central pedestal 74 may be connected to the third central pedestal 64. In one embodiment, the fourth central pedestal 74 is further comprised of means 22 (e., a flange or bracket) for connecting a fourth polygonal deck 76 to the fourth central pedestal 74. In this embodiment, no water supply leg is used to support the fourth polygonal deck 76. Rather, the fourth polygonal deck 76 is supported by third and fourth support members 78, 80, respectively. However, the first water supply leg 8 and fourth water supply leg 66 are used to supply pressurized water to water play elements 17 which may be installed on the fourth polygonal deck 76. The third support member 78 spans between the fourth water supply leg 66 and the fourth polygonal deck 76; the fourth support member 80 spans between the first water supply leg 8 and the fourth polygonal deck 76. Again, stairs 17*a* may be added to interconnect the third polygonal deck 68 with the fourth polygonal deck 76.

Figure 8A:
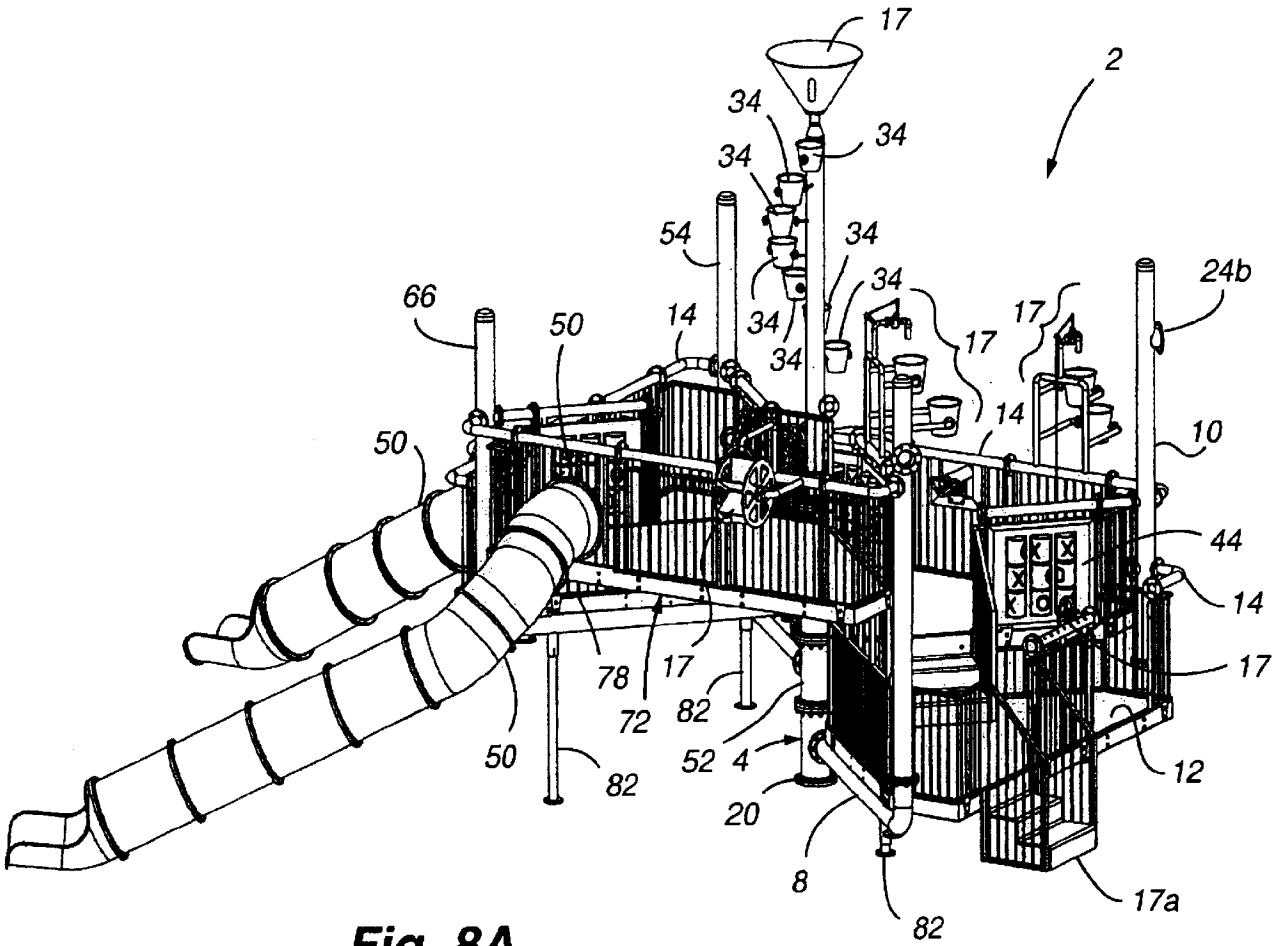
FIG. 8A is a side isometric perspective view of one embodiment of a four level modular water play structure with adjustable support columns.
Figure 8B:
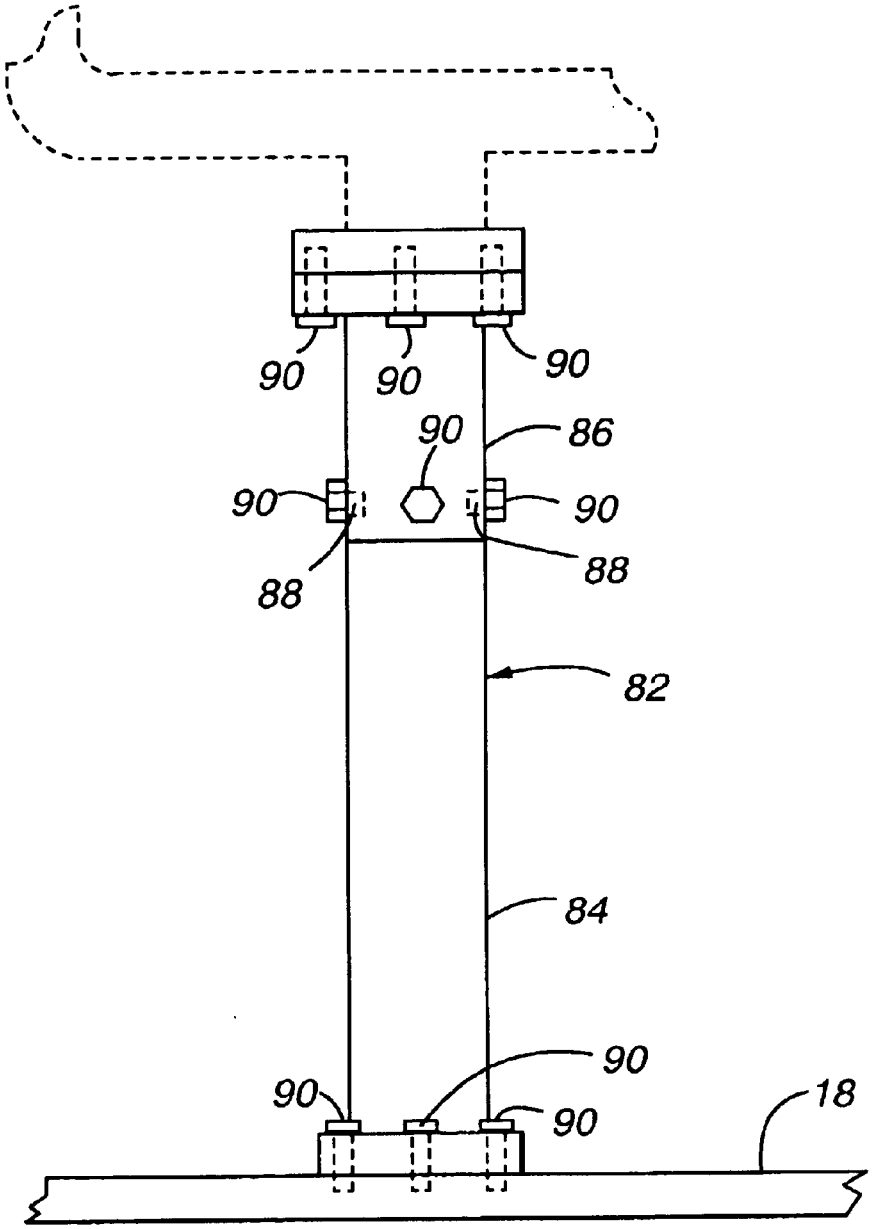
FIG. 8B is a side elevation view of one embodiment of an adjustable support column.

In order to provide further stability to the modular water play structure, as shown in FIGS. 8A and 8B, optional, adjustable support columns 82 can be positioned beneath the first, second, third, or fourth water supply legs 8, 10, 54, and 66, respectively. Each adjustable support column 82 can be extended to accommodate any height differences between the water supply legs and the pool floor 18.

In one preferred embodiment, each adjustable column 82 is comprised of a stationary post 84 in telescopic relationship with a sleeve 86. The stationary post 84 may be removably or fixedly connected to the pool floor 18 by bolts, glue, or other securement methods known in the art. Alternatively, the stationary post 84 may simply rest upon the pool floor 18. Even if the stationary post 84 is not secured to the pool floor 18 or, for that matter, if it rests above the pool floor 18, it will have the effect in many instances of supporting deck structure, especially if the deck structure begins to oscillate as a result of play participant activity. Once the telescoping sleeve 86 is adjusted to a proper height to either partially or fully support a polygonal deck, the telescoping sleeve 86 may be fixedly or removably connected to either a water supply leg and/or the underside of a polygonal deck via an attachment device, which may include a flange, bracket, or other coupling mechanism known in the art.

In order to ensure that the telescoping sleeve 86 stays in position, in one embodiment, the telescoping sleeve 86 is further comprised of a plurality of apertures 88 to accept bolts 90, which are temporarily or permanently tightened against the stationary post 84. See FIG. 8B. As one ordinarily skilled in the art can appreciate, other methods of adjusting and securing the adjustable support column 82 are within the spirit and scope of the present invention. Moreover, the adjustable support column 82, as well as the modular water play structure 2 generally, can be made out of a rust-resistant, durable metal, metal alloy, or other material having similar strength and non-corrosiveness characteristics, or a combination thereof.

If four levels are insufficient to accommodate the number of play participants, additional modular water play structures 2 may be added to the overall system. In such a preferred embodiment, the first central pedestal 4 may be modified to include a second supply line connection 92 (not shown, but identical to water supply line connection 6 in FIG. 2), which connects the first central pedestal 4 to an identical first central pedestal 4 that is similarly anchored at, near, or beneath a pool floor 18 at a sufficient distance from the first modular water play structure 2. The second modular play structure 2 can be built to the desired number of levels in the manner described above. Additional modular water play structures 2 can be added in like fashion, if desired.

The first, second, third, and fourth central pedestals 4, 52, 64, 74, respectively, and first, second, third and fourth water supply legs 8, 10, 54, and 66, respectively, are preferably made out of a rust-resistant, durable metal, such as stainless steel or other metals having similar strength and durability characteristics, and are to be of sufficient size and strength to safely support the modular water play structure 2 and play participants while also supplying pressurized water to the various interconnected water play elements 17. Similarly, all manners or shapes of pipe, tubing, or other functionally shaped water-carrying channel of sufficient strength may be used for the above-described central pedestals and water supply legs and still be within the spirit and scope of the invention.

Figure 5A:
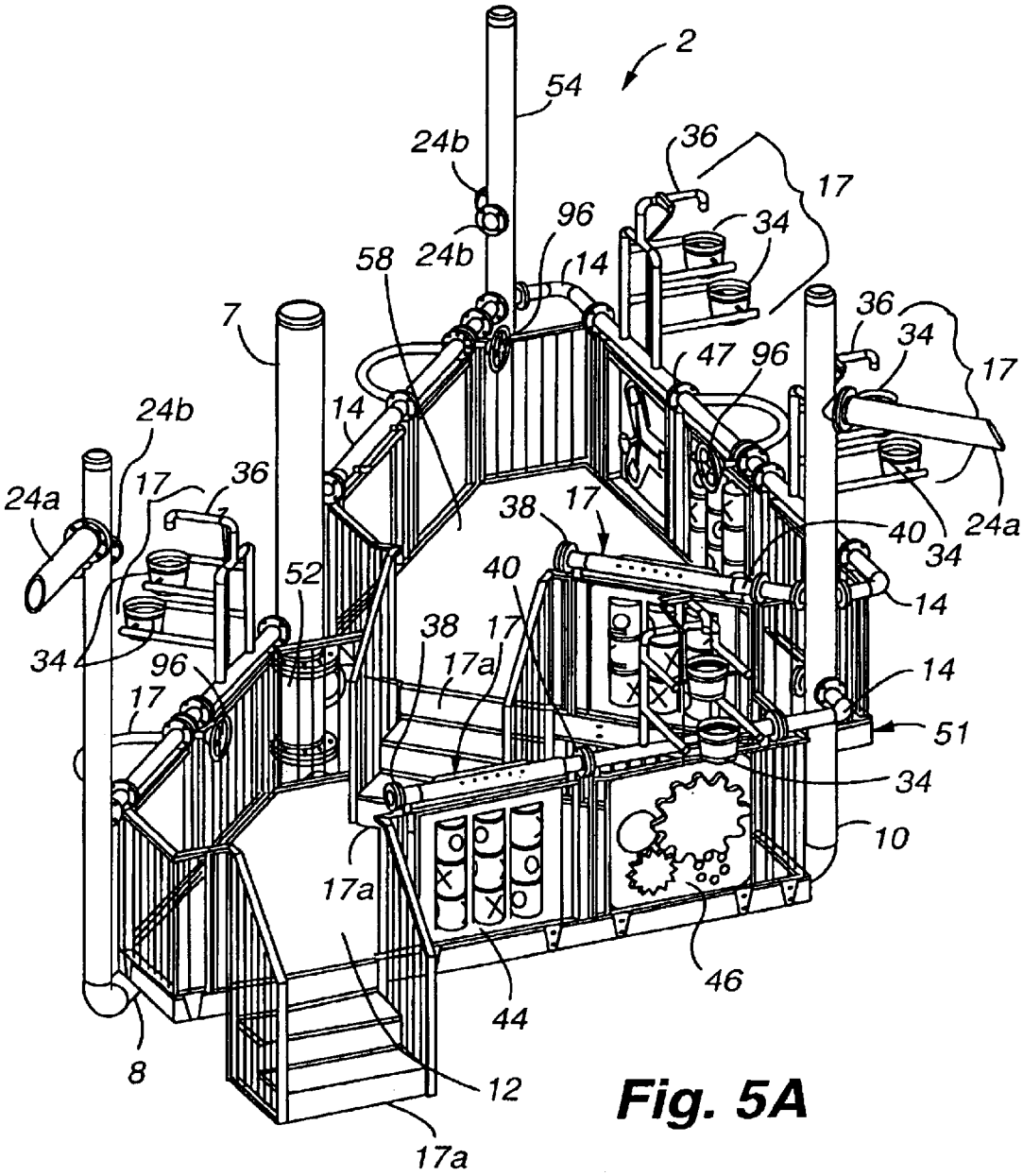
FIG. 5A is a front isometric perspective view of one embodiment of a two level modular water play structure.
Figure 5B:
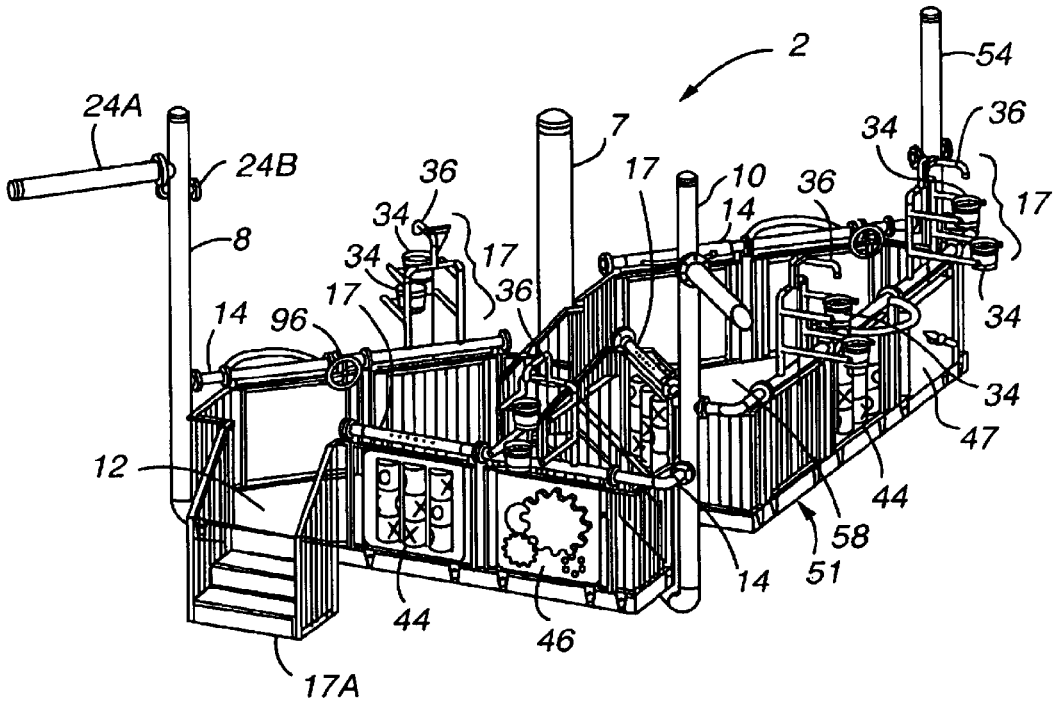
FIG. 5B is a slightly rotated front isometric perspective view of the two level modular water play structure shown in FIG. 5A.
Figure 5C:
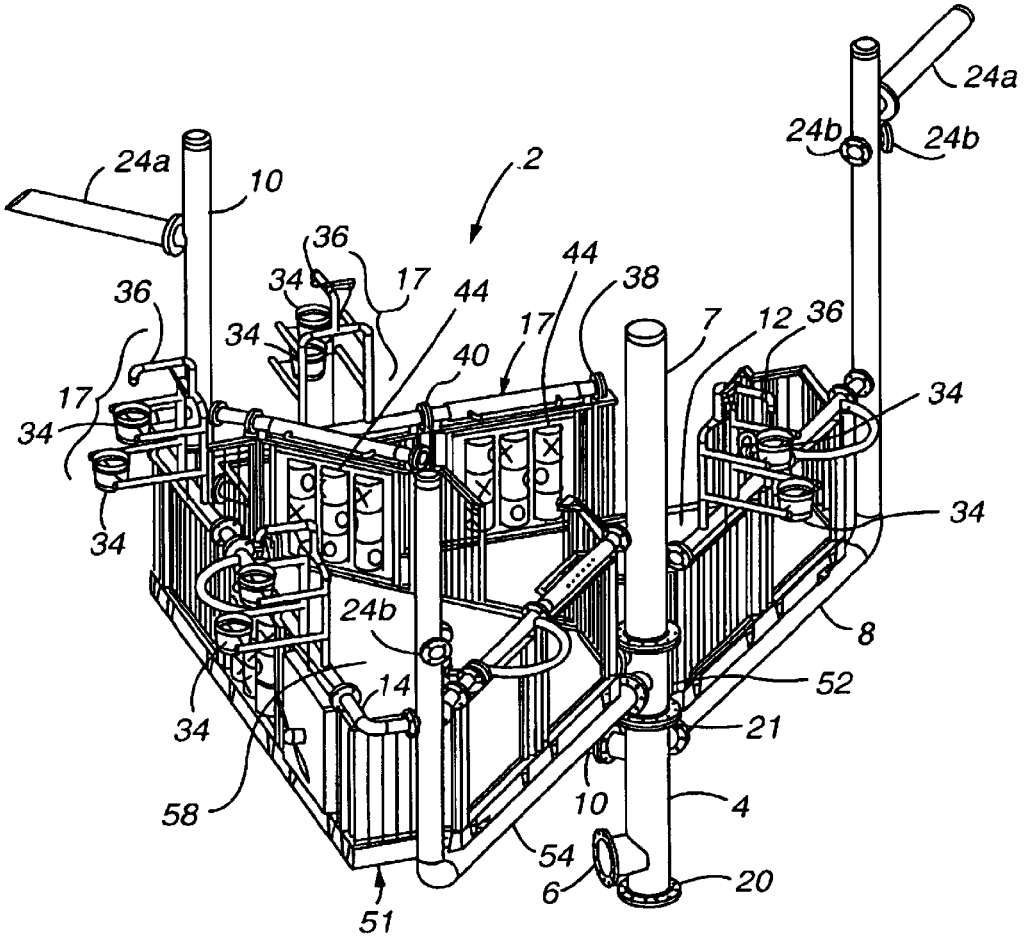
FIG. 5C is a rear isometric view of the modular water play structure shown in FIG. 5A.
Figure 6A:
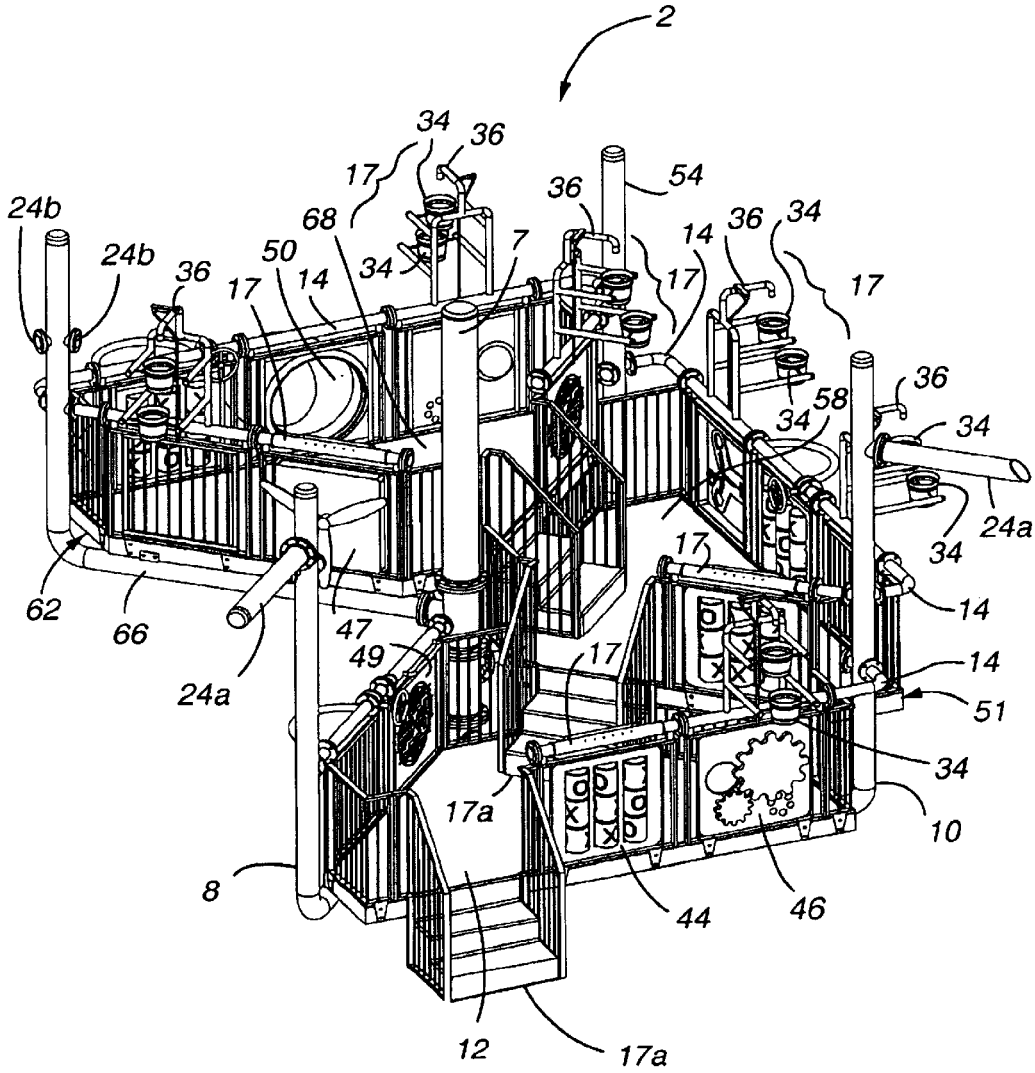
FIG. 6A is a front isometric perspective view of one embodiment of a three level modular water play structure.
Figure 6B:
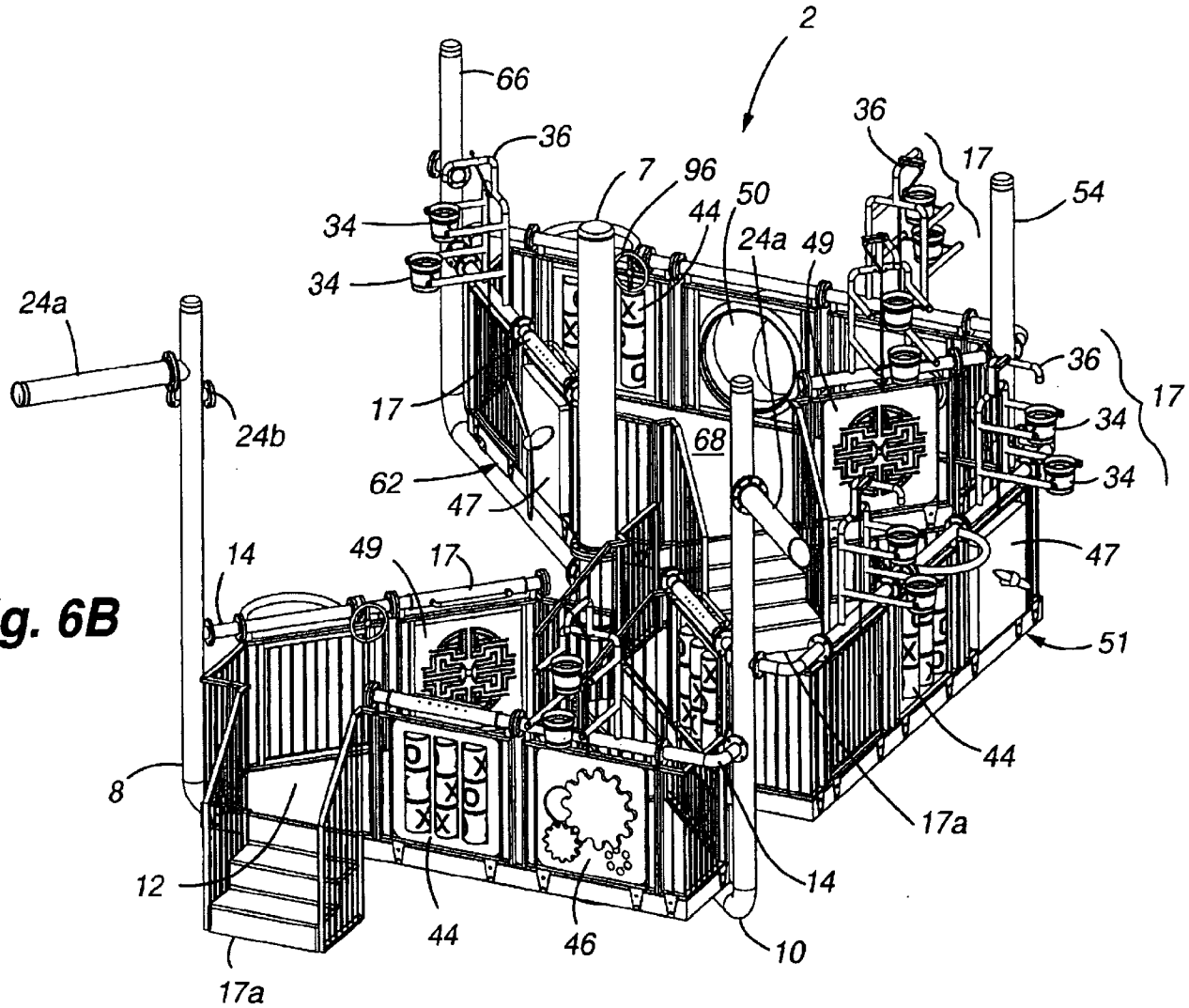
FIG. 6B is a slightly rotated front isometric view of the modular water play structure shown in FIG. 6A.
Figure 6C:
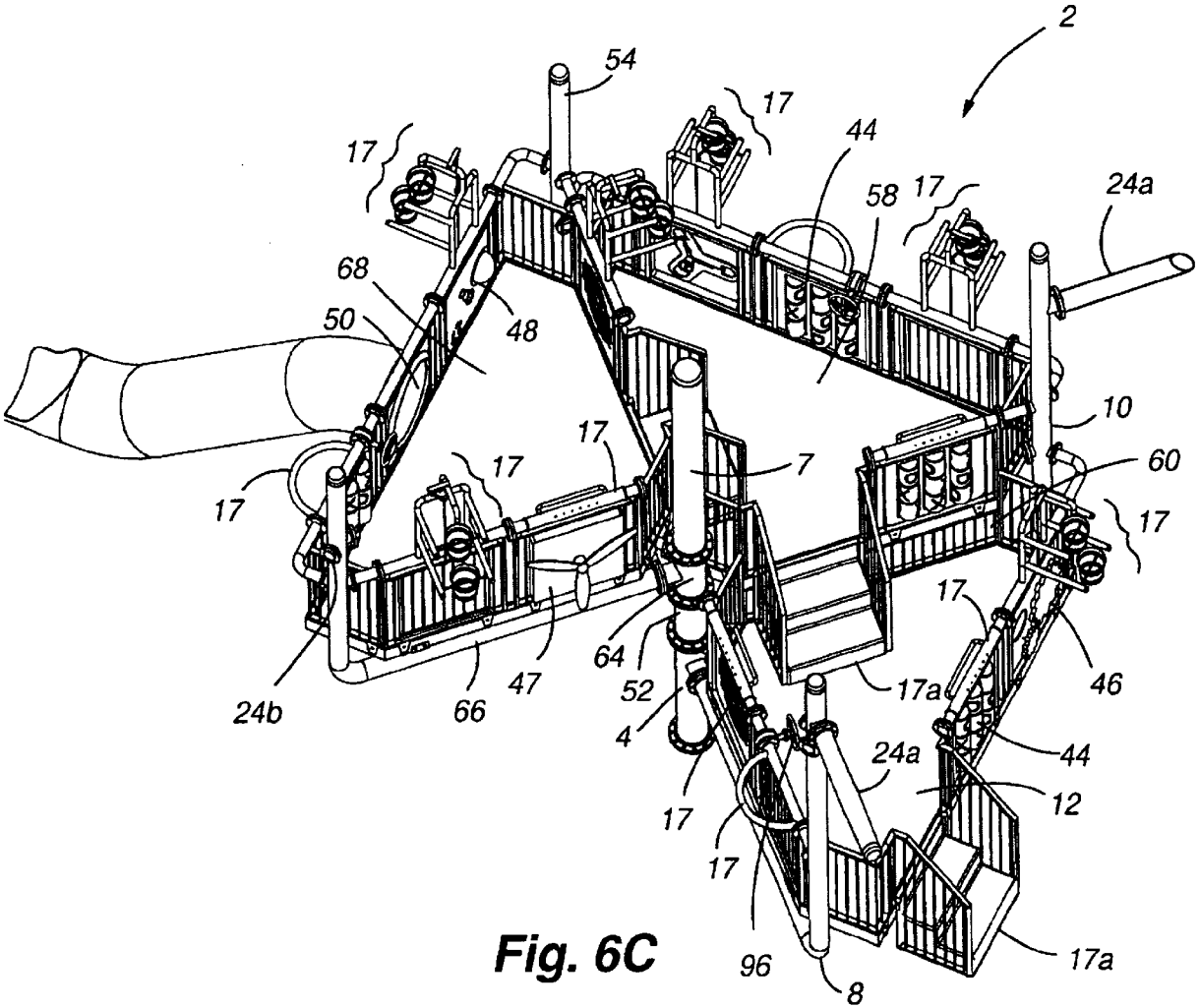
FIG. 6C is a top perspective view of the modular water play structure shown in FIG. 6A.
Figure 6D:
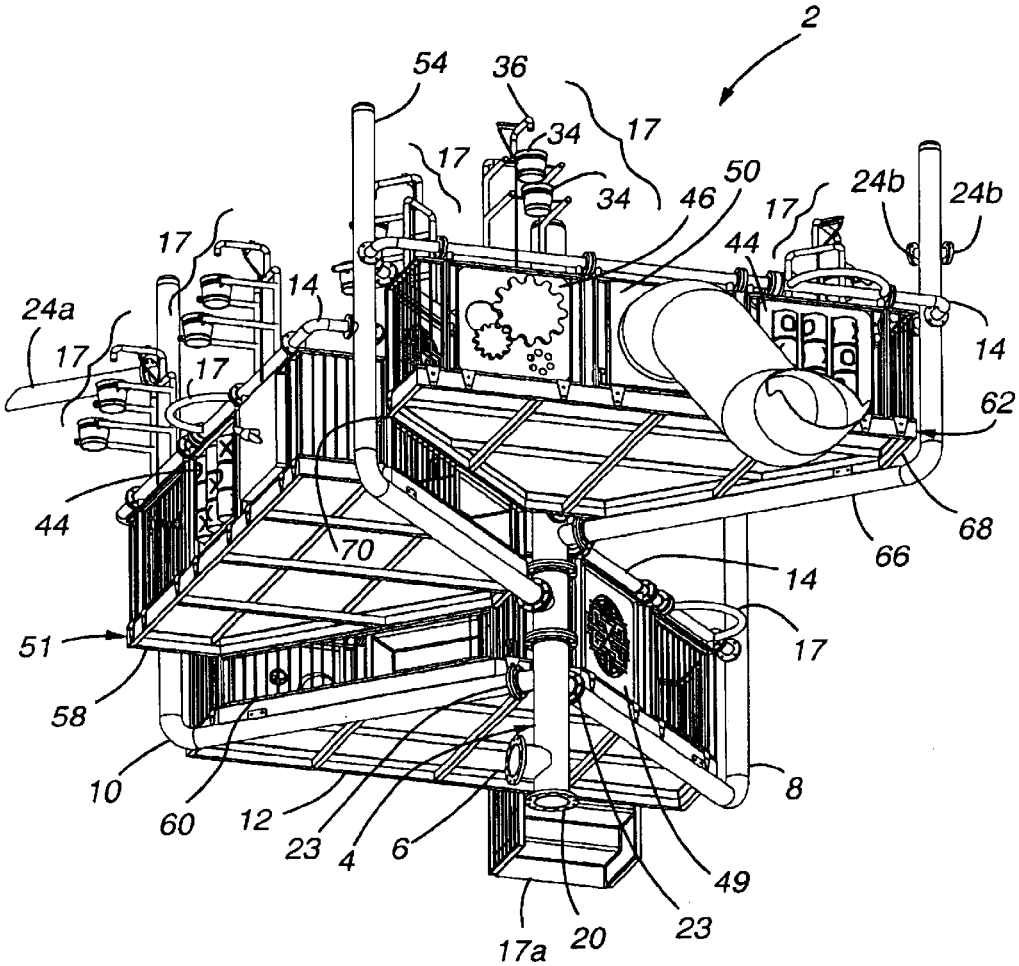
FIG. 6D is an isometric perspective view of the underside of one embodiment of a three level modular water play structure.

As one ordinarily skilled in the art can appreciate, the first, second, third, and fourth support members 60, 70, 78, and 80, respectively, can take various forms and be constructed of various materials and still be within the spirit and scope of the present invention. For example, railing/spindle configurations, as shown in FIGS. 3 and 5A or horizontally-positioned I-beams (not shown) can be used.

In addition, the previously described interconnections between the central pedestals, water supply legs, and railings can take various forms. For instance, coupling assemblies, threaded conduit, or other connections that are designed to accommodate pressurized fluids are well within the scope of the present invention. Moreover, gaskets 94 (shown in FIG. 7B) may optionally be used between some or all points of connection between water transferring conduit.

Figure 7A:
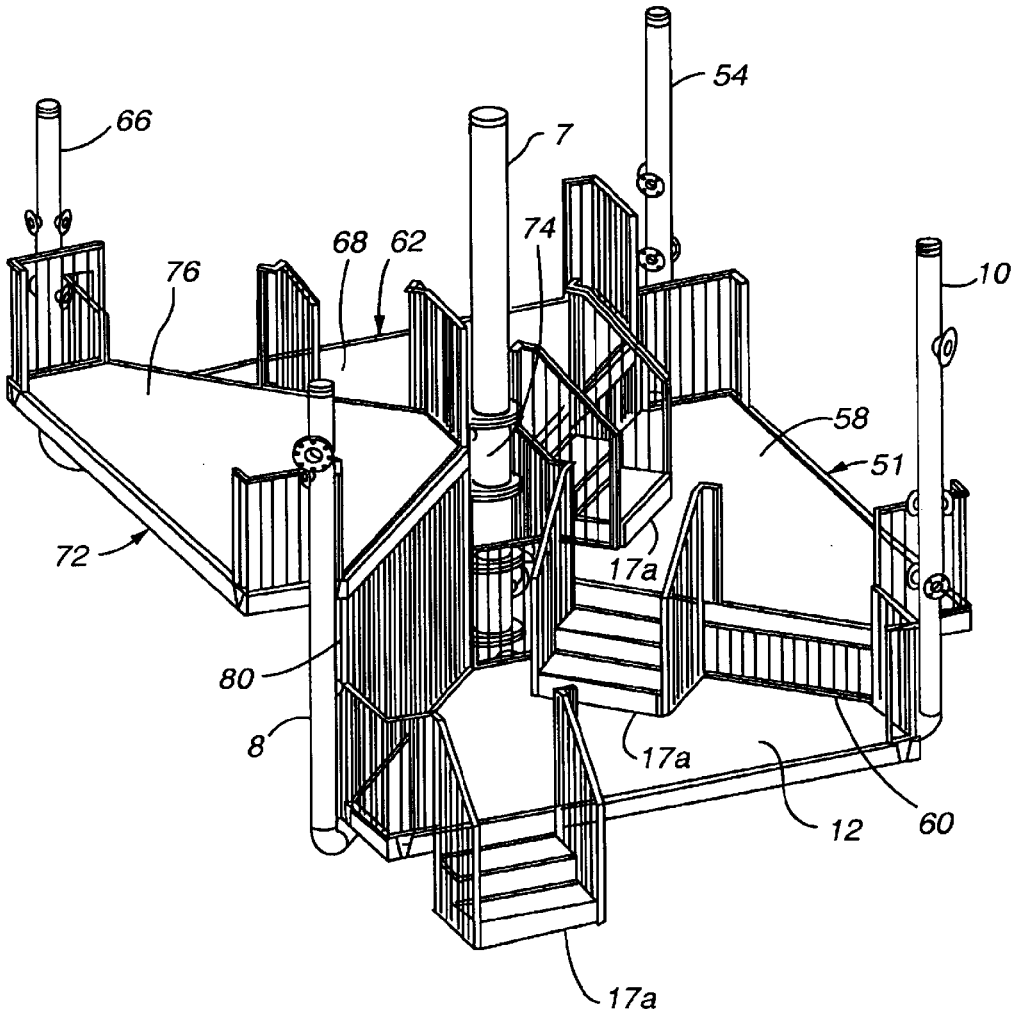
FIG. 7A is a front isometric perspective view of one embodiment of a four level modular water play structure.
Figure 7B:
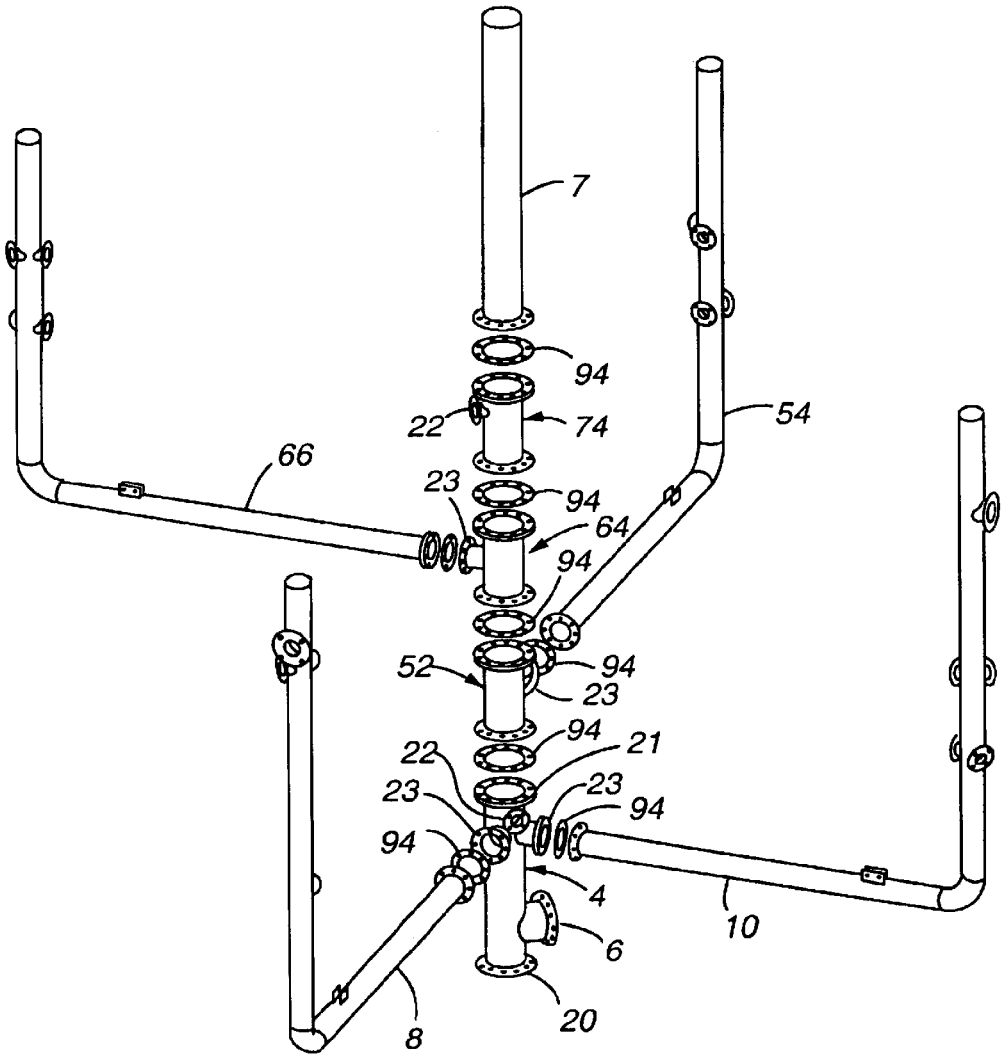
FIG. 7B is a front isometric perspective view of one embodiment of the infrastructure for a four level modular water play structure.
Figure 7C:
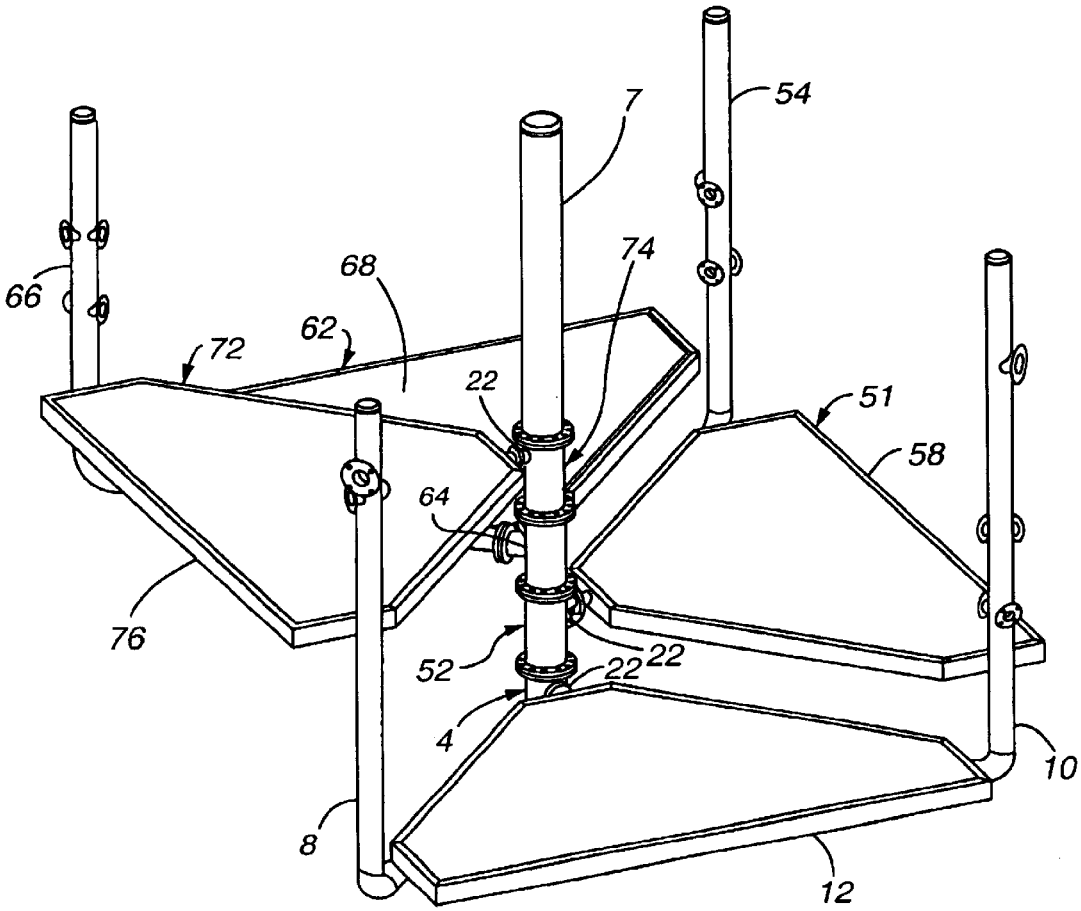
FIG. 7C is a front isometric perspective view of one embodiment of a four level modular water play structure without interactive play modules.
Figure 7D:
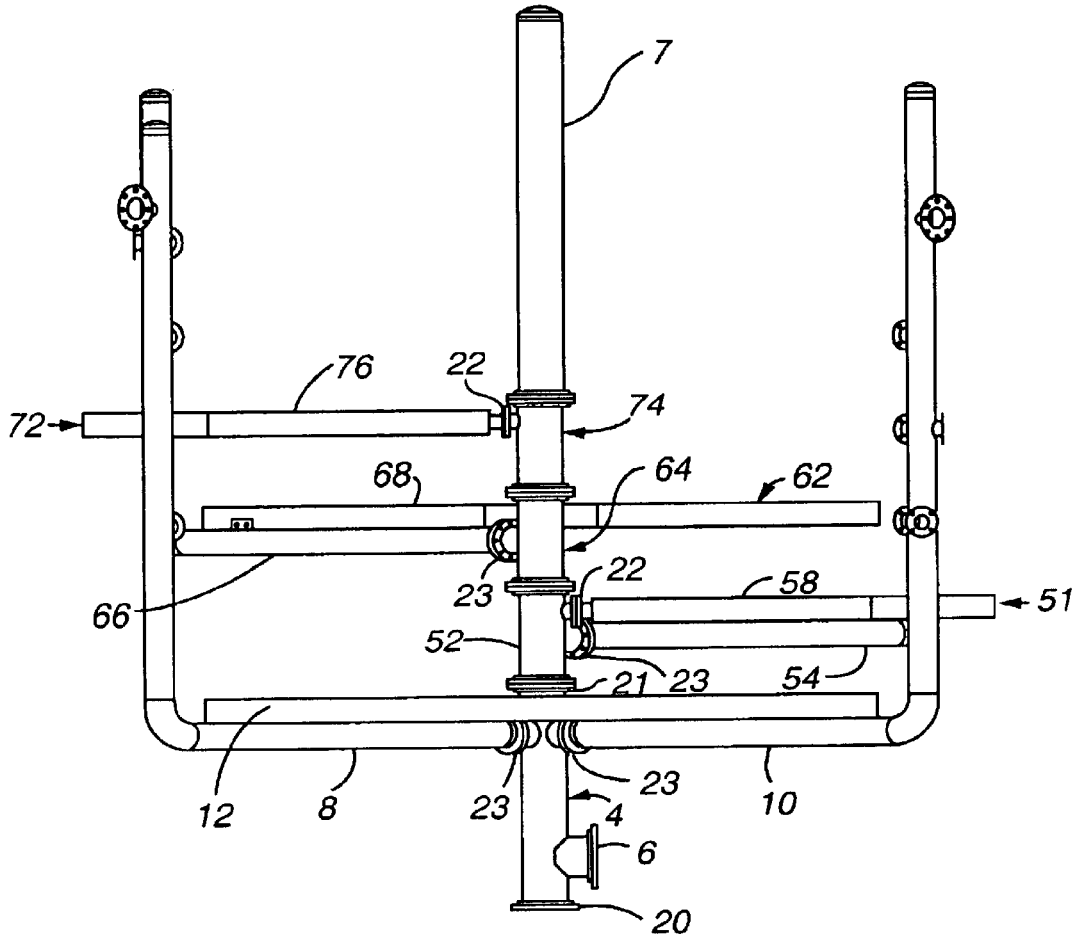
FIG. 7D is a front elevation view of the modular water play structure shown in FIG. 7C.
Figure 7E:
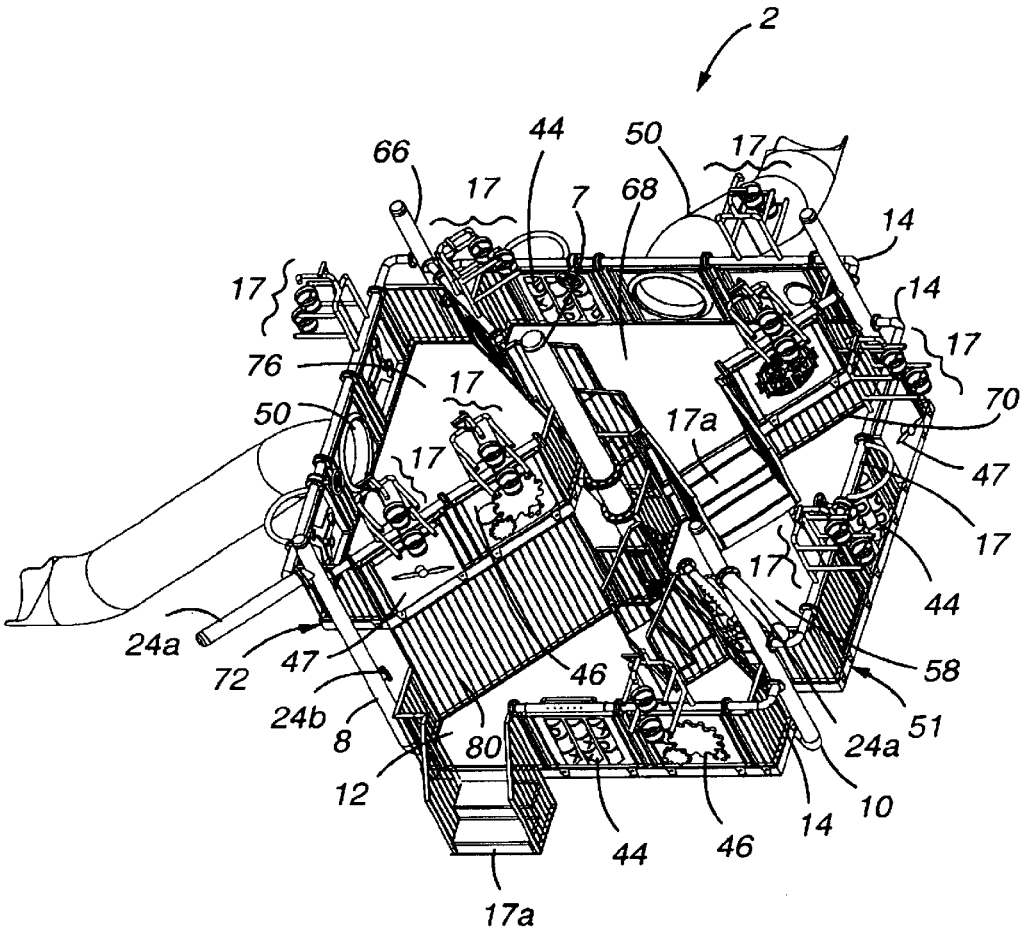
FIG. 7E is a top isometric perspective view of one embodiment of a four level modular water play structure.
Figure 7F:
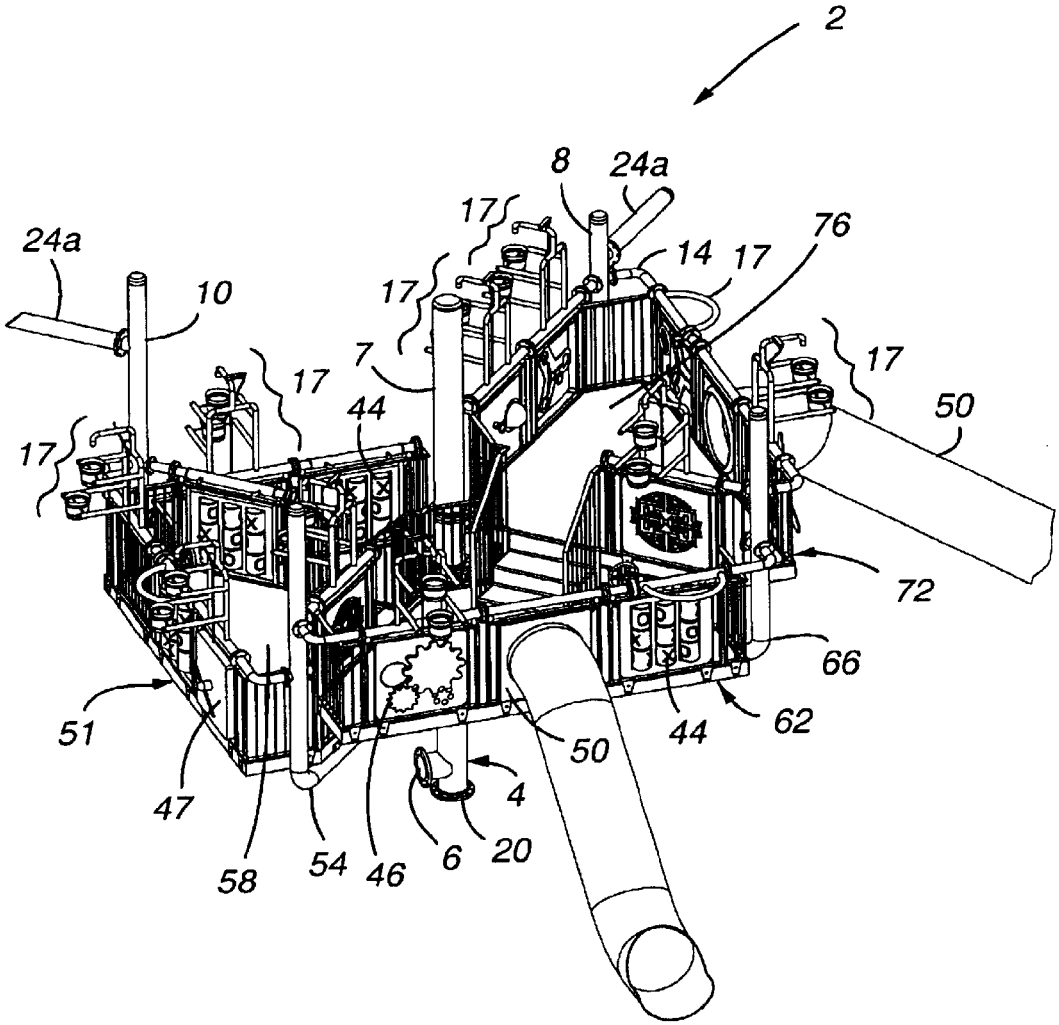
FIG. 7F is a rear isometric perspective view of the modular play structure shown in FIG. 7D.
Figure 7G:
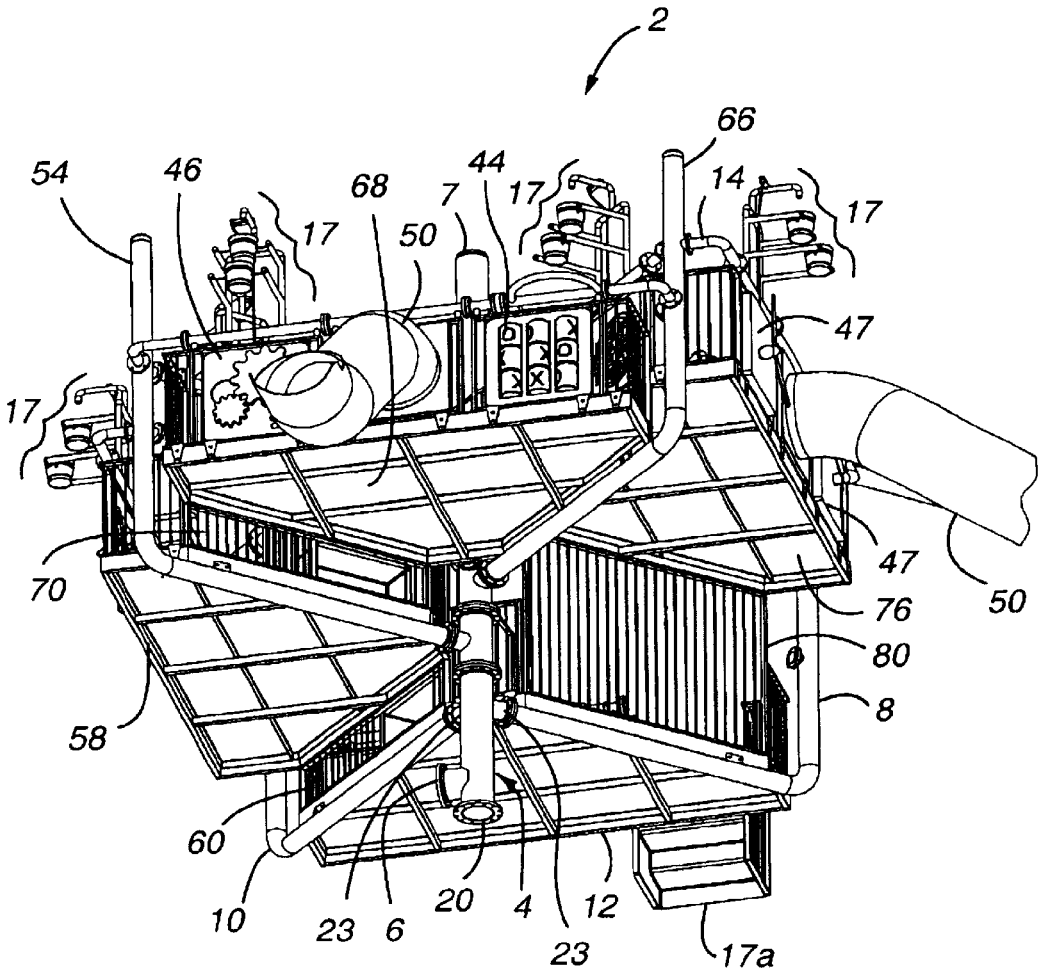
FIG. 7G is an isometric perspective view of the underside of the modular play structure shown in FIG. 7D.

The first, second, third, and fourth polygonal decks 12, 58, 68, and 76, respectively, can also vary in shape, thickness, and size. Preferably, each polygonal deck has at least three sides and is made from fiberglass or other material providing a non-slip, non-corrosive, non-degrading surface. As shown in FIG. 7C, in one embodiment, each polygonal deck is hexagonal. Various means for connecting each polygonal deck to each respective central pedestal or water supply leg can be used, such as flanged connections or brackets. Any such connection method is deemed within the skill of those working in this art.

In order to operate the water play elements 17 on the various levels of the modular water play structure 2, play participants turn valves 96 (as shown in FIG. 1B), which are strategically placed along the railings 14 or other areas of the system. Various valves 96, such as butterfly, gate, etc., may be used alone, or in combination and still be within the scope of the present invention. Water flow may also be increased or decreased to a particular section of the modular water play structure 2 by adjusting the respective valve 96.

As noted above, the pool 3 can vary in depth, size and configuration. As one ordinarily skilled in the art can appreciate, filtration and water structures are to be incorporated per local building code or other requirements.

While an effort has been made to describe some alternatives to the preferred embodiment, other alternatives will readily come to mind to those skilled in the art. Therefore, it should be understood that the invention may be embodied in other specific forms without departing from the spirit or central characteristics thereof. The present examples and embodiments, therefore, are to be considered in all respects as illustrative and not restrictive, and the invention is not intended to be limited to the details given herein.

What is claimed is:

1. A water play structure comprising:

(a) a hollow central pedestal having at least one supply conduit for receiving pressurized fluid;

(b) a supply leg in fluid communication with the central pedestal and capable of transporting pressurized fluid;

(c) a deck at least partially supported by the supply leg;

(d) at least one water play element in fluid communication with the supply leg; and wherein the hollow central pedestal is the only fluid-carrying conduit that contacts a ground surface or a pool floor.

2. The water play structure of claim 1, further comprising at least one support column having a first end and a second end, wherein the first end communicates either with the deck or the supply leg and the second end is positioned near the pool floor.

3. The water play structure of claim 2, wherein the support column is connected to the pool floor.

4. The water play structure of claim 2, wherein the support column is adjustable to a plurality of heights.

5. The water play structure of claim 2, wherein the first end of the support column is a sleeve which cooperates in a telescopic manner with the second end of the support column.

6. The water play structure of claim 1, further comprising a second supply leg in fluid communication with the central pedestal.

7. The water play structure of claim 1, wherein the water play element communicates with the supply leg via at least one hollow railing.

8. The water play structure of claim 1, further comprising a flow control device communicating with the water play element so that a play participant can selectively activate the water play element.

9. The water play structure of claim 8, wherein the flow control device is a valve.

10. The water play structure of claim 8, wherein the flow control device is a valve selected from the group consisting of a butterfly valve, a lever controlled valve, or a gate valve.

11. The water play structure of claim 1, wherein the hollow central pedestal is adapted to accept a second pedestal that can be attached to a surface of the hollow central pedestal to create a multi-level water play structure.

12. The water play structure of claim 1, wherein the supply leg is L-shaped.

13. The water play structure of claim 1, further comprising a basin for collecting water emitted from the water play element.

14. The water play structure of claim 13, further comprising a pump for circulating water from the basin to the supply conduit.

15. The water play structure of claim 1, wherein the deck includes an upper surface having a non-slip coating.

16. The water play structure of claim 1, further comprising at least one interactive play apparatus removably connected to the deck.

17. The water play structure of claim 16, wherein the at least one interactive play apparatus is a Tic-Tac-Toe module.

18. The water play structure of claim 16, wherein the at least one interactive play apparatus is a slide.

19. The water play structure of claim 1, wherein the water play element is selected from the group consisting of a spout, a sprinkler, or a faucet.

20. The water play structure of claim 1, further comprising at least one stair connected to the deck.

21. The water play structure of claim 1, wherein the hollow central pedestal is in fluid communication with a second water play structure.

22. The water play structure of claim 1, wherein the deck is substantially triangular in shape.

23. The water play structure of claim 1, wherein the deck is substantially square in shape.

24. The water play structure of claim 1, wherein the deck is substantially rectangular in shape.

25. The water play structure of claim 1, wherein the deck is polygonal in shape.

26. The water play structure of claim 1, wherein the deck is substantially circular in shape.

27. The water play structure of claim 1, wherein the deck is substantially elliptical in shape.

28. The water play structure of claim 1, wherein the deck is substantially oval in shape.

29. The water play structure of claim 1, wherein the deck is asymmetrical in shape.

30. A spiral, multi-level, water play apparatus comprising:

(a) a first central pedestal adapted to transmit pressurized fluid received from a supply;

(b) a first water supply leg and a second water supply leg in fluid communication to the first central pedestal;

(c) a first deck, adapted to support play participants and which is at least partially supported by the first water supply leg and the second water supply leg;

(d) a first hollow railing in fluid communication with the first water supply leg;

(e) a second hollow railing in fluid communication with the second water supply leg;

(f) a second central pedestal in fluid communication with and attached to the first central pedestal and adapted to transmit pressurized fluid;

(g) a third water supply leg in fluid communication with the second central pedestal;

(h) a third hollow railing in fluid communication with the third water supply leg;

(i) a second deck at least partially supported by either the third water supply leg or first deck; and (j) a play element, at least partially in fluid communication with either the first or second water supply leg.

31. The multi-level water play apparatus of claim 30, wherein the play element is selected from the group consisting of a spout, a sprinkler, or a faucet.

32. A modular play structure comprising:

(a) a first central pedestal in fluid communication with at least one play element and a second modular play structure having a second central pedestal;

(b) a first fluid supply leg in fluid communication with the first central pedestal and capable of transporting pressurized fluid to the at least one play element;

(c) a deck capable of supporting play participants; and wherein the second modular play structure receives fluid from the first central pedestal.

33. The modular play structure of claim 32, further comprising a second fluid supply leg in fluid communication with the first central pedestal.

34. The modular play structure of claim 32, further comprising at least one hollow railing in fluid communication with the first fluid supply leg.

35. The modular play structure of claim 32, wherein the play element is a hollow railing with perforations.

36. The modular play structure of claim 32, further comprising at least one interactive play apparatus.

37. A water play structure comprising:

(a) a central pedestal in fluid communication with a pressurized fluid supply;

(b) a supply leg in fluid communication with the central pedestal;

(c) a deck at least partially supported by the supply leg;

(d) at least one play element in fluid communication with the central pedestal; and (e) at least one non-fluid carrying support column communicating with the deck or the supply leg; and wherein the central pedestal is the only fluid-carrying conduit that contacts a ground surface or a pool floor.

38. The water play structure of claim 37, further comprising at least one interactive play apparatus.

39. The water play structure of claim 38, wherein the interactive play apparatus is a slide.

40. The water play structure of claim 38, wherein the interactive play apparatus is a Tic-Tac-Toe module.

41. The water play structure of claim 37, wherein the play element is selected from the group consisting of a spout, a sprinkler, or a faucet.

42. The water play structure of claim 37, wherein the at least one play element is a hollow railing.

43. The water play structure of claim 37, further comprising a pump for transporting pressurized fluid to the central pedestal.

44. The water play structure of claim 43, wherein the pump is connected to an underside of the deck.

45. The water play structure of claim 43, wherein the pump is remotely positioned in relation to the central pedestal.

46. The water play structure of claim 37, further comprising a basin with a drain.

47. The water play structure of claim 37, wherein the support column is adjustable to a plurality of heights.

48. The water play structure of claim 37, wherein the support column is removably connected to the pool floor.

49. The water play structure of claim 37, wherein the support column is fixedly connected to the pool floor.

50. The water play structure of claim 37, wherein the deck is polygonal in shape.

51. The water play structure of claim 37, wherein the deck is circular in shape.

52. The water play structure of claim 37, wherein the deck is oval in shape.

53. The water play structure of claim 37, wherein the deck is elliptical in shape.

54. The water play structure of claim 37, wherein the deck is asymmetrical in shape.

55. An interactive play module adapted for use with a water play structure comprising:

(a) a frame;

(b) an interactive play apparatus removably connected to the frame;

(c) a water play element removably connected to the frame; and (d) a plurality of members used to attach the frame to a water play structure.

56. The interactive play module of claim 55, wherein the interactive play apparatus is a slide.

57. The interactive play module of claim 55, wherein the interactive play apparatus is a Tic-Tac-Toe module.

58. The interactive play module of claim 55, further comprising means for controlling a water supply which communicates with the water play element.

59. The interactive play module of claim 58, wherein the means for controlling a water supply is a valve.

60. The interactive play module of claim 59, wherein the valve is selected from the group consisting of a butterfly valve, a lever controlled valve, or a gate valve.

61. The interactive play module of claim 55, wherein the water play element is a hollow railing.

62. The interactive play module of claim 55, wherein the water play element is selected from the group consisting of a spout, a sprinkler, or a faucet.

63. A water play structure comprising:

(a) at least one platform;

(b) a central pedestal partially supporting the at least one platform and capable of transmitting pressurized fluid;

(c) at least one water play element in fluid communication with the central pedestal;

(d) a means for supplying fluid to the central pedestal; and wherein the central pedestal is the only fluid-carrying conduit that contacts a ground surface or a pool floor.

64. The water play structure of claim 63, further comprising means for partially supporting the platform.

65. The water play structure of claim 64, wherein the means for partially supporting the platform is a support column.

66. The water play structure of claim 65, wherein the support column is adjustable to a plurality of heights.

67. The water play structure of claim 63, further comprising an interactive play apparatus.

* * * * *